US008105463B2

(12) United States Patent
Goulet et al.

(10) Patent No.: US 8,105,463 B2
(45) Date of Patent: Jan. 31, 2012

(54) CREPED TISSUE SHEETS TREATED WITH AN ADDITIVE COMPOSITION ACCORDING TO A PATTERN

(75) Inventors: Mike T. Goulet, Neenah, WI (US); Thomas Joseph Dyer, Neenah, WI (US); Christopher Michael Wilson, Atlanta, GA (US); Jeffrey J. Timm, Menasha, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 287 days.

(21) Appl. No.: 12/407,882

(22) Filed: Mar. 20, 2009

(65) Prior Publication Data

US 2010/0236735 A1 Sep. 23, 2010

(51) Int. Cl.
*B31F 1/12* (2006.01)

(52) U.S. Cl. ..... 162/112

(58) Field of Classification Search ..... 162/112
See application file for complete search history.

(56) References Cited

U.S. PATENT DOCUMENTS

| | | | |
|---|---|---|---|
| 3,338,992 | A | 8/1967 | Kinney |
| 3,341,394 | A | 9/1967 | Kinney |
| 3,502,538 | A | 3/1970 | Petersen |
| 3,502,763 | A | 3/1970 | Hartmann |
| 3,542,615 | A | 11/1970 | Dobo et al. |
| 3,556,932 | A | 1/1971 | Coscia et al. |
| 3,556,933 | A | 1/1971 | Williams et al. |
| 3,575,173 | A | 4/1971 | Loyer |
| 3,585,104 | A | 6/1971 | Kleinert |
| 3,645,992 | A | 2/1972 | Elston |
| 3,669,822 | A | 6/1972 | Cowen |
| 3,692,618 | A | 9/1972 | Dorschner et al. |
| 3,700,623 | A | 10/1972 | Keim |
| 3,772,076 | A | 11/1973 | Keim |
| 3,802,817 | A | 4/1974 | Matsuki et al. |
| 3,849,241 | A | 11/1974 | Butin et al. |
| 3,855,158 | A | 12/1974 | Petrovich et al. |
| 3,879,257 | A | 4/1975 | Gentile et al. |
| 3,899,388 | A | 8/1975 | Petrovich et al. |
| 4,076,698 | A | 2/1978 | Anderson et al. |
| 4,100,324 | A | 7/1978 | Anderson et al. |
| 4,129,528 | A | 12/1978 | Petrovich et al. |
| 4,147,586 | A | 4/1979 | Petrovich et al. |
| 4,222,921 | A | 9/1980 | Van Eenam |
| 4,309,510 | A | 1/1982 | Kleber |
| 4,326,000 | A | 4/1982 | Roberts, Jr. |
| 4,340,563 | A | 7/1982 | Appel et al. |
| 4,355,066 | A | 10/1982 | Newman |
| 4,375,448 | A | 3/1983 | Appel et al. |
| 4,440,898 | A | 4/1984 | Pomplun et al. |
| 4,494,278 | A | 1/1985 | Kroyer et al. |
| 4,514,345 | A | 4/1985 | Johnson et al. |
| 4,528,239 | A | 7/1985 | Trokhan |
| 4,574,021 | A | 3/1986 | Endres et al. |
| 4,594,130 | A | 6/1986 | Chang et al. |
| 4,599,392 | A | 7/1986 | McKinney et al. |
| 4,640,810 | A | 2/1987 | Laursen et al. |
| 4,793,898 | A | 12/1988 | Laamanen et al. |
| 4,818,464 | A | 4/1989 | Lau |
| 4,837,070 | A | 6/1989 | Weber et al. |
| 4,950,545 | A | 8/1990 | Walter et al. |
| 4,975,320 | A | 12/1990 | Goldstein et al. |
| 4,988,781 | A | 1/1991 | McKinney et al. |
| 5,008,344 | A | 4/1991 | Bjorkquist |
| 5,085,736 | A | 2/1992 | Bjorkquist |
| 5,094,886 | A | 3/1992 | Bogardy |
| 5,098,522 | A | 3/1992 | Smurkoski et al. |
| 5,104,923 | A | 4/1992 | Steinwand et al. |
| 5,109,063 | A | 4/1992 | Cheng et al. |
| 5,129,988 | A | 7/1992 | Farrington, Jr. |
| 5,160,484 | A | 11/1992 | Nikoloff |
| 5,227,242 | A | 7/1993 | Walter et al. |
| 5,260,171 | A | 11/1993 | Smurkoski et al. |
| 5,272,236 | A | 12/1993 | Lai et al. |
| 5,275,700 | A | 1/1994 | Trokhan |
| 5,278,272 | A | 1/1994 | Lai et al. |
| 5,298,124 | A | 3/1994 | Eklund et al. |
| 5,328,565 | A | 7/1994 | Rasch et al. |
| 5,334,289 | A | 8/1994 | Trokhan et al. |
| 5,382,400 | A | 1/1995 | Pike et al. |
| 5,384,373 | A | 1/1995 | McKinney et al. |
| 5,385,643 | A | 1/1995 | Ampulski |
| 5,389,202 | A | 2/1995 | Everhart et al. |
| 5,389,204 | A | 2/1995 | Ampulski |

(Continued)

FOREIGN PATENT DOCUMENTS

| | | | |
|---|---|---|---|
| CA | 2 273 912 | A1 | 6/1999 |

(Continued)

OTHER PUBLICATIONS

International Search Report and Written Opinion, PCT/IB2010/050334, mail date Sep. 15, 2010.

ASTM Designation: D 1238-04c entitled Standard Test Method for Melt Flow Rates of Thermoplastics by Extrusion Plastometer, Dec. 1, 2004, pp. 1-14.

ASTM Designation: D 792-98 entitled Standard Test Method for Density and Specific Gravity (Relative Density) of Plastics by Displacement, Aug. 10, 1998, pp. 159-163.

Material Safety Data Sheet from DuPont Dow Elastomers L. L. C., for "ENGAGE", Mar. 29, 1999, 7 pages.

Paper entitled "Polymer Nanocomposite" by Chou et al. of The Dow Chemical Company, 2002, 5 pages.

(Continued)

*Primary Examiner* — Mark Halpern
(74) *Attorney, Agent, or Firm* — Dority & Manning, P.A.

(57) ABSTRACT

Tissue sheets are disclosed containing an additive composition. The additive composition is applied to the tissue sheet during a creping process in a controlled manner such that the additive composition forms deposits on the sheet separated by untreated areas. In one embodiment, the additive composition is applied to a creping surface. A wet tissue sheet is then transferred to the creping surface by a topographical surface containing elevations. The elevations press the tissue sheet against the creping surface. When creped from the surface, the additive compositions transfers to the tissue sheet according to where the elevations were located on the topographical surface.

13 Claims, 10 Drawing Sheets

U.S. PATENT DOCUMENTS 5,429,686 A 7/1995 Chiu et al.
5,431,786 A 7/1995 Rasch et al.
5,432,000 A 7/1995 Young et al.
5,496,624 A 3/1996 Stelljes, Jr. et al.
5,500,277 A 3/1996 Trokhan et al.
5,504,172 A 4/1996 Imuta et al.
5,514,523 A 5/1996 Trokhan et al.
5,518,585 A 5/1996 Huth et al.
5,527,171 A 6/1996 Soerensen
5,529,665 A 6/1996 Kaun
5,543,215 A 8/1996 Hansen et al.
5,554,467 A 9/1996 Trokhan et al.
5,558,873 A 9/1996 Funk et al.
5,566,724 A 10/1996 Trokhan et al.
5,573,637 A 11/1996 Ampulski et al.
5,595,628 A 1/1997 Gordon et al.
5,624,790 A 4/1997 Trokhan et al.
5,628,876 A 5/1997 Ayers et al.
5,656,132 A 8/1997 Farrington, Jr. et al.
5,672,248 A 9/1997 Wendt et al.
5,677,383 A 10/1997 Chum et al.
5,702,571 A 12/1997 Kamps et al.
5,830,320 A 11/1998 Park et al.
5,844,045 A 12/1998 Kolthammer et al.
5,869,575 A 2/1999 Kolthammer et al.
5,871,763 A 2/1999 Luu et al.
5,885,697 A 3/1999 Krzysik et al.
5,935,384 A 8/1999 Taniguchi
6,033,761 A 3/2000 Dwiggins et al.
6,039,838 A 3/2000 Kaufman et al.
6,054,020 A 4/2000 Goulet et al.
6,096,152 A 8/2000 Anderson et al.
6,096,169 A 8/2000 Hermans et al.
6,111,023 A 8/2000 Chum et al.
6,120,642 A 9/2000 Lindsay et al.
6,129,815 A 10/2000 Larson et al.
6,143,135 A 11/2000 Hada et al.
6,171,441 B1 1/2001 Phillips et al.
6,194,517 B1 2/2001 Pomplun et al.
6,197,154 B1 3/2001 Chen et al.
6,224,714 B1 5/2001 Schroeder et al.
6,231,719 B1 5/2001 Garvey et al.
6,274,667 B1 8/2001 Shannon et al.
6,287,418 B1 9/2001 Schroeder et al.
6,287,426 B1 9/2001 Edwards et al.
6,291,372 B1 9/2001 Mumick et al.
6,316,549 B1 11/2001 Chum et al.
6,361,784 B1 3/2002 Brennan et al.
6,365,667 B1 4/2002 Shannon et al.
6,379,498 B1 4/2002 Burns et al.
6,423,270 B1 7/2002 Wall
6,447,643 B2 9/2002 Fingal et al.
6,448,341 B1 9/2002 Kolthammer et al.
6,468,392 B2 10/2002 Oriarian et al.
6,525,157 B2 2/2003 Cozewith et al.
6,538,070 B1 3/2003 Cardwell et al.
6,566,446 B1 5/2003 Parikh et al.
6,570,054 B1 5/2003 Gatto et al.
6,610,174 B2 8/2003 Sun et al.
6,617,490 B1 9/2003 Chen et al.
6,664,309 B2 12/2003 Svenningsen et al.
6,716,203 B2 4/2004 Sorebo et al.
6,736,935 B2 5/2004 Hermans et al.
6,764,988 B2 7/2004 Koenig et al.
6,896,766 B2 5/2005 Sarbo et al.
6,908,966 B2 6/2005 Chang et al.
6,911,573 B2 6/2005 Chen et al.
6,913,673 B2 7/2005 Baggot et al.
6,939,440 B2 9/2005 Drew et al.
6,951,598 B2 10/2005 Flugge et al.
6,960,635 B2 11/2005 Stevens et al.
6,964,725 B2 11/2005 Shannon et al.
6,979,757 B2 12/2005 Powers
6,991,706 B2 1/2006 Lindsay et al.
6,994,865 B2 2/2006 Branham et al.
7,063,895 B2 6/2006 Rodrigues et al.
7,156,953 B2 1/2007 Tirimacco et al.
7,182,837 B2 2/2007 Chen et al.
7,189,307 B2 3/2007 Goulet et al.
7,229,529 B2 6/2007 Goulet et al.
7,297,231 B2 11/2007 Goulet et al.
7,306,699 B2 12/2007 Urlaub et al.
7,361,694 B2 4/2008 Strandburg et al.
7,396,593 B2 7/2008 Liu et al.
7,419,570 B2 9/2008 Chen et al.
7,422,658 B2 9/2008 Hermans et al.
7,476,293 B2 1/2009 Herman et al.
7,485,373 B2 2/2009 Krzysik et al.
7,749,356 B2 7/2010 Runge et al.
7,785,443 B2 8/2010 Hermans et al.
7,789,995 B2 9/2010 Super et al.
7,803,865 B2 9/2010 Moncla et al.
7,807,023 B2 10/2010 Dyer et al.
7,820,010 B2 10/2010 Lostocco et al.
7,837,831 B2 11/2010 Dyer et al.
7,837,832 B2 11/2010 Fetner et al.
7,842,163 B2 11/2010 Nickel et al.
7,879,188 B2 2/2011 Dyer et al.
7,879,189 B2 2/2011 Dyer et al.
7,879,190 B2 2/2011 Dyer et al.
7,879,191 B2 2/2011 Dyer et al.
7,883,604 B2 2/2011 Dyer et al.
7,899,885 B2 3/2011 Aultman et al.
2003/0027470 A1 2/2003 Chang et al.
2003/0121627 A1 7/2003 Hu et al.
2004/0020114 A1 2/2004 Boehmer et al.
2004/0118540 A1 6/2004 Garnier et al.
2004/0131842 A1 7/2004 Urlaub et al.
2004/0191486 A1 9/2004 Underhill et al.
2004/0209539 A1 10/2004 Confalone et al.
2005/0058693 A1 3/2005 Wael et al.
2005/0058833 A1 3/2005 Krzysik et al.
2005/0100754 A1 5/2005 Moncla et al.
2005/0118435 A1 6/2005 Delucia et al.
2005/0124753 A1 6/2005 Ashihara et al.
2005/0136766 A1 6/2005 Tanner et al.
2005/0192365 A1 9/2005 Strandburg et al.
2005/0214335 A1 9/2005 Allen et al.
2005/0217874 A1 10/2005 Forster et al.
2005/0224200 A1 10/2005 Bouchard et al.
2005/0224201 A1 10/2005 Anderson et al.
2005/0241789 A1 11/2005 Reddy
2006/0070712 A1 4/2006 Runge et al.
2006/0086472 A1 4/2006 Hermans et al.
2006/0237154 A1 10/2006 Edwards et al.
2007/0020315 A1 1/2007 Shannon et al.
2007/0137811 A1 6/2007 Runge et al.
2007/0141936 A1 6/2007 Bunyard et al.
2007/0295465 A1 12/2007 Dyer et al.
2008/0073046 A1 3/2008 Dyer et al.

FOREIGN PATENT DOCUMENTS

DE 4142460 A1 6/1993
EP 0 608 460 A1 8/1994
EP 0 620 256 A2 10/1994
EP 0 857 453 A1 8/1998
EP 0 926 288 A1 6/1999
EP 1 344 511 A2 9/2003
GB 2 246 373 A 1/1992
WO WO 95/01479 A1 1/1995
WO WO 97/33921 A1 9/1997
WO WO 99/34057 A1 7/1999
WO WO 00/01745 A1 1/2000
WO WO 00/66835 11/2000
WO WO 01/15903 A1 3/2001
WO WO 01/47699 A1 7/2001
WO WO 01/49933 A2 7/2001
WO WO 02/48458 A1 6/2002
WO WO 03/040442 A1 5/2003
WO WO 2005/021622 A2 3/2005
WO WO 2005/021638 A2 3/2005
WO WO 2005/031068 A1 5/2005
WO WO 2005/080677 A2 9/2005
WO WO 2005/090427 A2 9/2005
WO WO 2006/038977 A1 4/2006
WO WO 2007/070114 A1 6/2007
WO WO 2007/070129 A1 6/2007

| | | | |
|---|---|---|---|
| WO | WO 2007/070145 | A1 | 6/2007 |
| WO | WO 2007/070153 | A1 | 6/2007 |
| WO | WO 2007/075356 | A2 | 7/2007 |
| WO | WO 2007/078342 | A1 | 7/2007 |
| WO | WO 2007/078499 | A1 | 7/2007 |
| WO | WO 2008/050246 | A1 | 5/2008 |

OTHER PUBLICATIONS

Product Information for Affinity EG 8200 (Polyolefin Plastomer for General Plastomeric Applications) from The Dow Chemical Company, May 2001, 2 pages.

TAPPI-T 411 om-89 entitled "Thickness (caliper) of paper, paperboard, and combined board", Jun. 15, 1989, 3 pages.

CREPED TISSUE SHEETS TREATED WITH AN ADDITIVE COMPOSITION ACCORDING TO A PATTERN

BACKGROUND

Absorbent tissue products such as paper towels, facial tissues, bath tissues and other similar products are designed to include several important properties. For example, the products should have good bulk, a soft feel and should be highly absorbent. In addition, the products should also have sufficient strength for the particular application and environment in which they are to be used.

In the past, those skilled in the art have developed various processes for enhancing and improving various properties of tissue products. For example, in order to increase bulk and improve softness, tissue products have been subjected to creping processes. For example, in one embodiment, a creping adhesive is sprayed onto a rotating drum, such as a Yankee dryer. A tissue web is then adhered to the outside surface as the drum is rotating. A creping blade is then used to remove the tissue web from the surface of the drum. Creping the web from the drum foreshortens the web and can break fiber to fiber bonds which both increases the bulk and softness of the product.

In United States Patent Application Publication Number U.S. 2008/0073046, which is incorporated herein by reference, a creping process as described above is disclosed that is useful for not only creping tissue webs, but can also be used to incorporate beneficial additives into the tissue sheet during the creping process. In particular, the '046 application teaches applying an additive composition to the surface of a creping drum that adheres the sheet to the surface of the drum. During creping, the additive composition transfers to the tissue sheet in amounts sufficient to improve at least one property of the tissue sheet. The additive composition can comprise, for instance, a thermoplastic polymer resin, a lotion, a debonder, a softener, and the like.

Applying additives as described above to tissue sheets may improve various properties of the sheets. Unfortunately, however, some of the additives may have hydrophobic characteristics and thus may have a tendency to interfere with the ability of the tissue sheet to absorb fluids, such as water. Thus, even though the inventions described in the '046 application provide great advancements in the art, further improvements may be needed. For instance, a need exists for a process for applying an additive composition to a tissue sheet during a creping process that leaves untreated areas on the sheet for allowing uninhibited liquid absorption.

SUMMARY

In general, the present disclosure is directed to a method for applying an additive composition to a base sheet. In addition, as will be described in greater detail below, the base sheet may also be subjected to a creping process while the additive composition is being applied to the base sheet. Of particular advantage, the additive composition can be applied to the base sheet according to a pattern such that the additive composition forms deposits on the base sheet leaving untreated portions for the absorption of fluids.

For example, in one embodiment, the present disclosure is directed to a process for applying an additive composition to a tissue sheet. The process includes the steps of first forming a wet tissue web. The tissue web can me made from any suitable papermaking fibers and can be formed from an aqueous suspension of the fibers. In accordance with the present disclosure, the wet tissue web is transferred to a topographical surface. The topographical surface includes elevations. For instance, in one embodiment, the topographical surface may comprise a woven fabric containing knuckles that comprise the elevations. The knuckles, for instance, may extend from the surface of the fabric. Alternatively, the topographical surface may comprise an imprinting fabric containing deflection elements. In this embodiment, the deflection elements may have any suitable shape.

An additive composition in accordance with the present disclosure is applied to a creping surface. The additive composition can comprise any suitable composition that at least lightly adheres the tissue web to the creping surface and is intended to be transferred to the tissue sheet. The additive composition, for instance, may comprise a composition that improves one of the characteristics or properties of the tissue sheet after being transferred.

After the additive composition is applied to the creping surface, the tissue web is pressed against the creping surface while being supported by the topographical surface. The elevations on the topographical surface form contact areas between the tissue web and the creping surface.

The tissue web is then creped from the creping surface. During the creping process, the additive composition is transferred to a surface of the tissue web forming deposits. The deposits form on the surface of the tissue web at locations corresponding to where the elevations on the topographical surface were located. In particular, the deposits are created on the tissue sheet where the contact areas are formed between the tissue web and the creping surface by the topographical surface.

Thus, the deposits that form on the tissue web are positioned according to a pattern that corresponds to the locations where the elevations reside on the topographical surface. As used herein the term "pattern" merely means that the location of the deposits corresponds with the location of the elevations on the topographical surface. The deposits, for instance, may appear to be placed over the surface of the tissue web in a random fashion. In other embodiments, the deposits may have some type of uniform spacing over the surface of the web. In still another embodiment, the deposits may appear in a recticular pattern, such as in the form of a grid having a plurality of interconnecting solid lines.

In addition to the deposits, the additive composition may also be applied to the tissue web in other forms. For example, in one embodiment, the creping process may further form "shavings" comprised of the additive composition that are randomly dispersed over the surface of the tissue web. The shavings, for instance, can overlap at least some of the deposits and can have a greater density of the additive composition in comparison to the deposits. In other words, the additive composition has a thicker mass in the areas of the shavings as opposed to the areas of the deposits. The thickness of the shavings, for instance, may be at least twice as thick as the deposits. For instance, the shavings can be three times, four times, five times, ten times, or even greater than the thickness of the deposits. The shavings, for instance, may occur due to the action of a creping blade against the creping surface. The creping blade may form the shavings which then transfer to the surface of the tissue web.

As described above, the process of producing the tissue sheet involves forming a wet web and pressing the wet web against the creping surface. The consistency of the wet web when pressed against the surface can vary depending upon the particular application. In one embodiment, for instance, the web can be dewatered to a consistency of from about 30% to about 60% when transferred to the topographical surface and then when pressed against the creping surface.

The present disclosure is also directed to a creped tissue sheet made according to the above described process. The creped tissue sheet can contain papermaking fibers and can include an additive composition located on a first side of the sheet. The additive composition may be present in the form of a pattern that includes deposits of the additive composition separated by untreated areas. The creped tissue sheet can further comprise shavings of the additive composition randomly associated with the pattern of deposits on the first side of the sheet.

The basis weight of the tissue sheet and the amount the additive composition is applied to the sheet can vary depending upon many numerous factors. In one embodiment, for instance, the basis weight of the tissue sheet may be from about 10 gsm to about 60 gsm, such as from about 10 gsm to about 45 gsm. The additive composition may be present on the first side of the tissue sheet in an amount from 1% to about 50% by weight of the tissue sheet. The additive composition, for instance, may cover from about 5% to about 80% of the surface area of the first side of the sheet. In general, the tissue sheet has a bulk of at least 3 cc/g, such as at least 8 cc/g.

In accordance with the present disclosure, the additive composition may comprise any suitable composition capable of adhering the base sheet to the creping surface while also being capable of transferring to the base sheet after the base sheet is removed from the creping surface. The additive composition can comprise, for instance, a thermoplastic polymer, such as a dispersion containing a thermoplastic polymer. In other embodiments, the additive composition may comprise a lotion, a softener, a debonder for cellulosic fibers, or any combination thereof. For example, in one embodiment, the additive composition may comprise a thermoplastic polymer combined with a lotion, a thermoplastic polymer combined with a debonder, or a thermoplastic polymer combined with a softener.

In still another embodiment, the additive composition may comprise an adhesive, such as a latex polymer. The adhesive or latex polymer may be combined with any of the above described additives. Examples of adhesives that may be used include, for instance, vinyl acetates, ethylene oxide copolymers, polyacrylates, and natural and synthetic rubber materials, such as styrene butadiene rubbers. In still another embodiment, the adhesive may comprise a starch, such as a starch blend.

Any of the above described additive compositions can also be combined with various other ingredients. For instance, in one embodiment, the additive composition may contain minor amounts of aloe and/or vitamin E that are intended to transfer to the base sheet from the creping surface.

As described above, in one embodiment, the additive composition may comprise a thermoplastic resin. The thermoplastic resin may be contained, for instance, in an aqueous dispersion prior to application to the creping surface. In one particular embodiment, the additive composition may comprise a non-fibrous olefin polymer. The additive composition, for instance, may comprise a film-forming composition and the olefin polymer may comprise an interpolymer of ethylene or propylene and at least one comonomer comprising an alkene, such as 1-octene. The additive composition may also contain a dispersing agent, such as a carboxylic acid. Examples of particular dispersing agents, for instance, include fatty acids, such as oleic acid or stearic acid.

In one particular embodiment, the additive composition may contain an ethylene and octene copolymer in combination with an ethylene-acrylic acid copolymer. The ethylene-acrylic acid copolymer is not only a thermoplastic resin, but may also serve as a dispersing agent. The ethylene and octene copolymer may be present in combination with the ethylene-acrylic acid copolymer in a weight ratio of from about 1:10 to about 10:1, such as from about 2:3 to about 3:2.

Other features and aspects of the present disclosure are discussed in greater detail below.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended figure in which.

Figure 1:
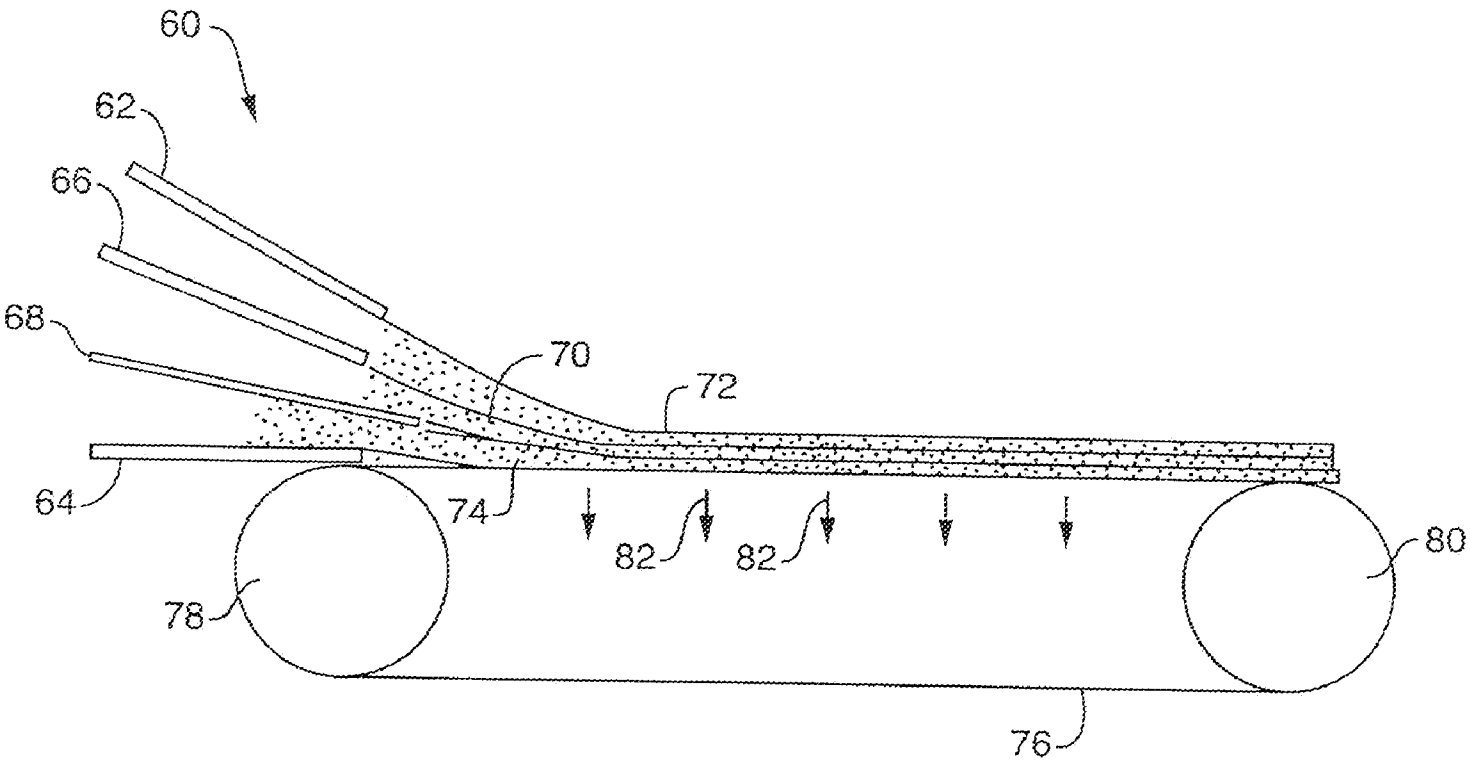
FIG. 1 is a schematic diagram of a tissue web forming machine, illustrating the formation of a stratified tissue web having multiple layers in accordance with the present disclosure.

Repeat use of reference characters in the present specification and drawings is intended to represent same or analogous features or elements of the invention.

DETAILED DESCRIPTION

It is to be understood by one of ordinary skill in the art that the present discussion is a description of exemplary embodiments only, and is not intended as limiting the broader aspects of the present disclosure.

In general, the present disclosure is directed to the incorporation of an additive composition into a sheet-like product, such as a tissue web. More particularly, the present disclosure is directed to applying an additive composition to a creping surface. The additive composition adheres a base sheet to the creping surface for creping the base sheet from the surface. In addition to adhering the base sheet to the creping surface, the additive composition also transfers to the base sheet in amounts sufficient to increase the basis weight, such as more than 1% by weight of the tissue sheet. In this manner, sufficient amounts of the additive composition can be transferred to a sheet in order to improve one or more properties of the base sheet. In addition, during the process, the base sheet can be creped which may also increase the softness and bulk of the base sheet.

In accordance with the present disclosure, the base sheet or tissue web is supported by a topographical surface when pressed against the creping surface. The topographical surface, for instance, may include elevations. The elevations create contact areas between the base sheet and the creping surface. Thus, the base sheet not only adheres to the creping surface where the elevations are located, but also most of the additive composition is transferred to the base sheet corresponding to locations of the elevations. In this manner, deposits are formed on the base sheet that are separated by untreated areas. Consequently, the additive composition is transferred to the tissue sheet in a controlled manner so as not to interfere with the ability of the base sheet to absorb liquids, such as water.

The process of the present disclosure is particularly well suited to applying compositions that may have some hydrophobic characteristics to hydrophilic base sheets. In one embodiment, for instance, the additive composition may contain a softening agent that is hydrophobic. According to the present disclosure the softening agent can be applied to the base sheet at discrete locations for increasing the softness of the base sheet while also providing untreated areas for liquid absorption and wicking.

In one embodiment, for instance, the topographical surface may comprise a woven fabric. The elevations that adhere the tissue web to the creping surface may comprise fabric knuckles. The fabric knuckles cause sheet adherence to the creping surface and also facilitate transfer of the additive composition to the surface of the sheet during creping. In this manner, the spacing of the additive composition transferred to the tissue sheet is dictated by the knuckle spacing of the impression fabric. This distribution pattern can be controlled and modified by changing the fabric weave pattern.

In addition to fabric knuckles, the elevations contained on the topographical surface may comprise other constructions as will be discussed in greater detail below.

The additive composition may contain various ingredients and components. For example, in one embodiment, the additive composition may comprise a lotion that improves the feel of the base sheet and/or may be available for transfer to a user's skin for moisturizing the skin and providing other benefits. In general, any suitable lotion composition may be used in accordance with the present disclosure as long as the lotion is capable of adhering the base sheet to a creping surface.

In an alternative embodiment, the additive composition may comprise a thermoplastic polymer, such as an aqueous dispersion containing a thermoplastic resin. Once transferred to the base sheet, the thermoplastic resin may be configured to increase the strength of the base sheet, to improve the feel of the base sheet, and/or to enhance various other properties of the base sheet.

In addition to a lotion and a thermoplastic polymer dispersion, the additive composition may contain various other ingredients. For instance, other ingredients that may be contained within the additive composition include an adhesive, a latex polymer, a wax, an oxidized polyethylene, a polyurethane, a starch, a debonder, a softener, and/or various other beneficial agents, such as aloe or vitamin E. For instance, in one embodiment, the additive composition may comprise a lotion and/or thermoplastic polymer dispersion that contains various other ingredients that are added to provide some type of benefit either to the product or to the user of the product. In still another embodiment, a lotion may be combined with a thermoplastic polymer dispersion to form the additive composition of the present disclosure.

The base sheet that may be processed according to the present disclosure can vary depending upon the particular application and the desired result. The base sheet may comprise, for instance, a tissue web containing cellulosic fibers. In alternative embodiments, the base sheet may comprise nonwoven webs containing cellulosic fibers and synthetic fibers such as hydroentangled webs and coform webs. In other embodiments, nonwoven webs, such as meltblown webs and spunbond webs may still be used. In still other embodiments, woven materials and knitted materials may also be used in the process as long as the materials are capable of being adhered to a creping surface and removed.

In one particular embodiment, for instance, the process of the present disclosure is directed to forming wet pressed tissue webs. In this embodiment, an aqueous suspension of paper making fibers is formed into a tissue web which is then adhered to a creping surface while wet. For example, referring to FIG. 2 one embodiment of a process for forming wet pressed creped tissue webs is shown.

Figure 2:
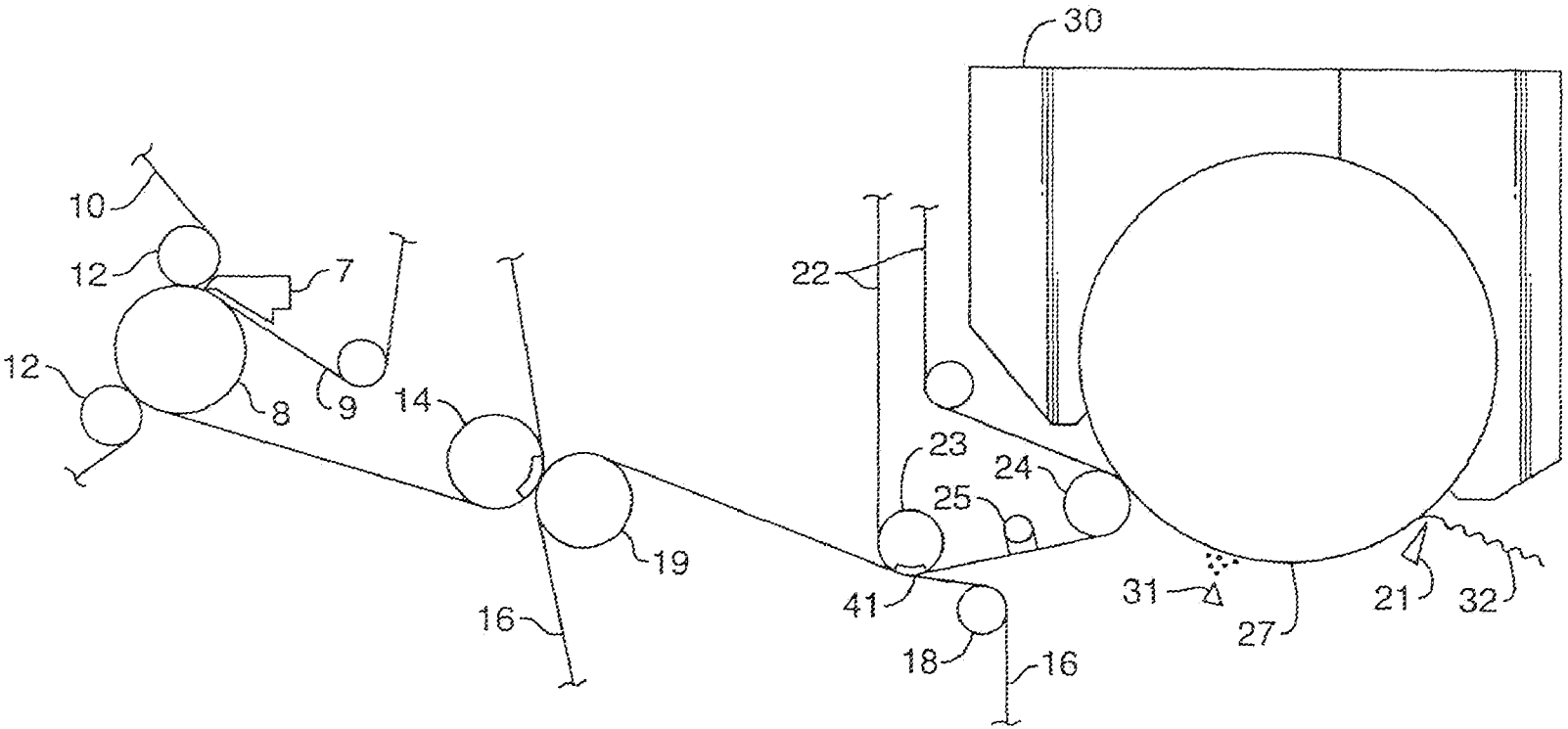
FIG. 2 is a schematic diagram of one embodiment of a process for forming wet pressed, creped tissue webs in accordance with the present disclosure.

The process shown in FIG. 2 generally comprises the steps of forming a wet tissue web by depositing an aqueous suspension of papermaking fibers onto a forming surface and dewatering the web using a pressure nip while supported by a felt. The wet web is then compressed between the felt and a particle belt. The dewatered web is then transferred to a topographical surface, such as a texturized fabric, with the aid of vacuum, to, in one embodiment, mold the dewatered web to the surface contours of the fabric. The web is then transferred to a moving creping surface while being supported by the topographical surface. An additive composition is applied to the creping surface which adheres the web thereto. The web is then dried and creped from the creping surface to produce the tissue sheet. During the creping process, the additive composition is transferred to the surface of the tissue web in a controlled and distinct manner resulting in a web that includes areas treated with the additive composition and areas that remain untreated.

In FIG. 2, a conventional crescent former is shown, although any standard wet former may be used. More specifically, a headbox 7 deposits an aqueous suspension of papermaking fibers between a forming fabric 10 and a felt 9 as they partially wrap forming roll 8. The forming fabric is guided by guide rolls 12. As used herein, a "felt" is an absorbent papermaking fabric designed to absorb water and remove it from a tissue web. Papermaking felts of various designs are well known in the art.

The newly-formed web is carried by the felt to the dewatering pressure nip formed between suction roll 14, particle belt 16 and press roll 19. In the pressure nip, the tissue web is dewatered to a consistency of from about 30% or greater, more specifically about 40% or greater, more specifically from about 40% to about 50%, and still more specifically from about 45% to about 50% as it is compressed between the felt and the impermeable particle belt 16. As used herein and well understood in the art "consistency" refers to the bone dry weight percent of the web based on fiber. The level of compression applied to the wet web to accomplish dewatering can be higher when producing light weight tissue webs.

As used herein, the "particle belt" is a water impermeable, or substantially water impermeable, transfer belt having many small holes and bumps in the otherwise smooth surface, the holes being formed from dislodged particles or gas bubbles previously embedded in the belt material when the belt is made. The size and distribution of the holes can be varied, but it is believed that the steep sidewall angles and size of these small holes prevents complete wetting of the belt surface because liquid water cannot enter them (similar physics to the Lotus leaf). The presence of the holes also brings entrained air in between the surface of the belt and the wet web. The presence of air or vapor aids in the break-up of the water film between the web and the surface of the belt and thereby reduces the level of adhesion between the web and the belt surface. In addition, a particle belt is not susceptible to the wear problems associated with a grooved belt because new holes are created as particles are uncovered and shed as the old holes are worn away. Examples of such particle belts are described in U.S. Pat. No. 5,298,124 issued Mar. 29, 1994 to Eklund et al. and entitled "Transfer Belt in a Press Nip Closed Drawer Transfer", which is hereby incorporated by reference.

Upon exiting the press nip, the sheet stays with the impermeable particle belt and is subsequently transferred to a topographical surface 22 with the aid of a vacuum roll 23 containing a vacuum slot 41. Press nip tension can be adjusted by the position of roll 18. An optional molding box 25 can be used to provide additional molding of the web to the topographical surface.

The topographical surface generally comprises a porous material containing elevations that extend from the surface. Many different types of materials may be used as the topographical surface. In one particular embodiment, for instance, the topographical surface comprises a three dimensional papermaking fabric.

A woven papermaking fabric, which has a topography that can form ridges and valleys in the tissue sheet when the dewatered sheet is molded to conform to its surface. More particularly, a texturizing fabric is a woven papermaking fabric having a textured sheet contacting surface with substantially continuous machine-direction elevations or ripples separated by valleys, the ripples being formed of multiple warp strands grouped together and supported by multiple shute strands of one or more diameters; wherein the width of ripples is from about 1 to about 5 millimeters, more specifically from about 1.3 to about 3 millimeters, and still more specifically from about 1.9 to about 2.4 millimeters. The frequency of occurrence of the ripples in the cross-machine direction of the fabric is from about 0.5 to about 8 per centimeter, more specifically from about 3.2 to about 7.9, still more specifically from about 4.2 to about 5.3 per centimeter. The rippled channel depth, which is the z-directional distance between the top plane of the fabric and the lowest visible fabric knuckle that the tissue web may contact, can be from about 0.2 to about 1.6 millimeters, more specifically from about 0.7 to about 1.1 millimeters, and still more specifically from about 0.8 to about 1 millimeter. For purposes herein, a "knuckle" is a structure formed by overlapping warp and shute strands.

It should be understood, however, the use of a three-dimensional fabric merely represents one embodiment of a topographical surface used in the process illustrated in FIG. 2. As will be described in greater detail below, for instance, in other embodiments discrete shapes such as deflection elements may be mounted on a porous substrate for forming the elevations.

The level of vacuum used to effect the transfer of the tissue web from the particle belt to the topographical surface will depend upon the nature of the topographical surface. The vacuum at the pick-up (vacuum transfer roll) plays a much more important role for transferring light weight tissue webs from the transfer belt to the topographical surface than it does for heavier paper grades. Because the wet web tensile strength is so low, the transfer must be complete before the belt and topographical surface separate-otherwise the web will be damaged. On the other hand, for heavier weight paper webs there is sufficient wet strength to accomplish the transfer, even over a short micro-draw, with modest vacuum (20 kPa). For light weight tissue webs, the applied vacuum needs to be much stronger in order to cause the vapor beneath the tissue to expand rapidly and push the web away from the belt and transfer the web to the fabric prior to fabric separation. On the other hand, the vacuum cannot be so strong as to cause pinholes in the sheet after transfer.

The transfer of the web to the topographical surface can include a "rush" transfer, or a "draw" transfer. Depending upon the nature of the topographical surface, rush transfer can aid in creating higher sheet caliper. When used, the level of rush transfer can be about 5 percent or less.

While supported by the topographical surface, the web is transferred to the surface of a Yankee dryer 27 via press roll 24, after which the web is dried and creped with a doctor blade 21. In accordance with the present disclosure, an additive composition is applied to the surface of the dryer 27 prior to pressing the web against the dryer. The additive composition adheres to the tissue web and also transfers to a surface of the tissue web as the web is creped.

The additive composition can be applied to the creping surface using any suitable technique. For instance, as shown in FIG. 2, in one embodiment, the additive composition can be sprayed onto the creping surface using a sprayer 31. In other embodiments, however, the additive composition can be printed onto the surface, extruded onto the surface, or applied using any suitable technique.

For example, when printed onto the surface, a flexographic printer may be used that applies the additive composition in a pattern. In other embodiments, a flooded nip may be used to apply the additive composition to the creping surface. In still other embodiments, the additive composition can be applied as a foam or can be applied according to plasma coating process.

The elevations of the topographical surface create contact points between the tissue web and the surface of the dryer. At these contact points, intimate contact is achieved between the tissue web and the additive composition. When the web is creped from the surface of the dryer, the additive composition transfers to the tissue sheet where the elevations were located. In this manner, deposits of the additive compositions form on the tissue sheet according to the pattern of the elevations.

Thus, the process results in simultaneously creping the tissue web and applying the additive composition to desired locations on the web. The deposits of the additive composition, for instance, can be surrounded by untreated areas of the web. Thus, all the benefits of the additive composition can be realized while also providing untreated areas that do not interfere with liquid absorption.

In accordance with the present disclosure, substantial amounts of the additive composition are transferred to the tissue web during the creping process. For instance, the basis weight of the web may increase by more than 1% by weight due to the amount of additive composition that is transferred. More particularly, the additive composition may be transferred to the web in an amount from about 2% to about 50% by weight, such as from about 2% to about 40% by weight, such as from about 2% to about 30% by weight. In various embodiments, for instance, the additive composition may transfer to the tissue web in an amount from about 2% to about 25% by weight, such as from an amount of about 2% to about 10% by weight.

During the process as shown in FIG. 2, the creping surface comprises the surface of the Yankee dryer. In order to dry the web, the surface is heated. For example, the creping surface can be heated to a temperature from about 80° C. to about 150° C., such as from about 100° C. to about 130° C.

The amount of time that the tissue web stays in contact with the creping surface can depend upon numerous factors. For instance, the base sheet can stay in contact with the creping surface in an amount as little as from about 100 milliseconds to 10 seconds or greater. During the process, the tissue web can be moving at a speed greater than about 1,000 feet per minute, such as from about 1,500 feet per minute to about 6,000 feet per minute.

As described above, substantial amounts of the additive composition are transferred to one side of the tissue web. The amount of surface area that the additive composition covers generally depends on the type of topographical surface that is used. In general, for instance, the additive composition covers greater than about 5% of the surface area of one side of the tissue web. For instance, the additive composition may cover from about 20% to about 80% of the surface of the tissue web, such as from about 20% to about 60% of the surface area of the tissue web.

As described above, the topographical surface can comprise numerous different types of materials. In general, any type of topographical surface may be used that includes elevations where desired. In one embodiment, for instance, three-dimensional fabrics may be used. Examples of three-dimensional woven fabrics that may be used as the topographical surfaces are shown, for instance, in FIGS. 3-7. It should be understood, however, that these fabrics are merely for exemplary purposes.

Figure 3:
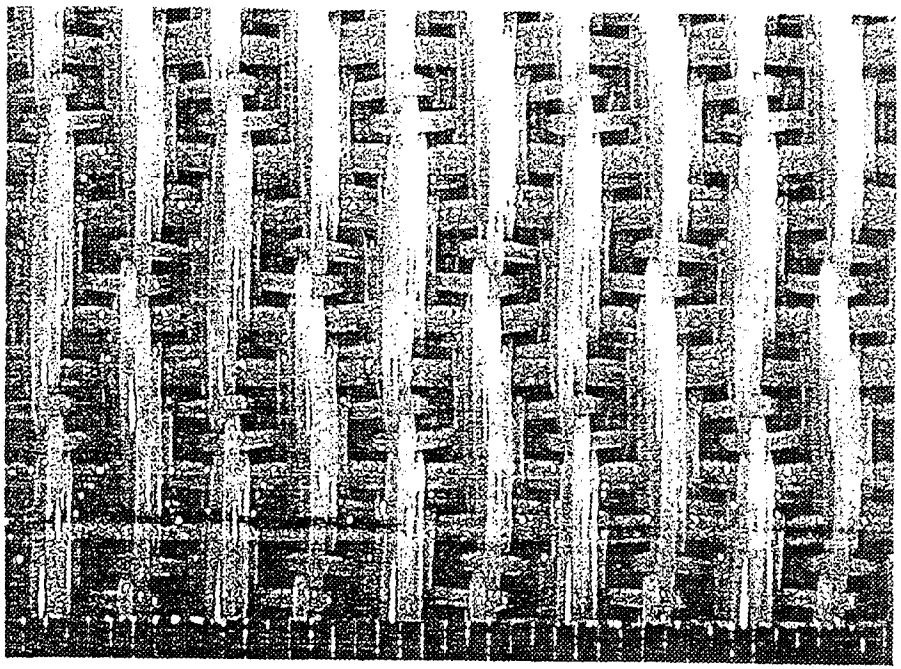
FIGS. 3-11 are planned views of different embodiments of topographical surfaces that may be used in conjunction with the process illustrated in FIG. 2.

FIG. 3, for instance, is a plan view photograph of the sheet contacting side of a papermaking fabric useful as a texturizing fabric for producing the tissue sheets of this invention, illustrating the spaced apart continuous or substantially continuous machine direction structures or elevations. FIG. 3 shows the weave pattern and specific locations of three different diameter shutes used to produce a deep, rippled structure in which the fabric ridges are higher and wider than individual warp strands. The fabric is a single layer structure in that all warps and shutes participate in both the sheet-contacting side of the fabric as well as the machine side of the fabric. The rippled channel depth is 0.967 mm or 293% of the combined warp and weighted-average shute diameters.

Figure 4:
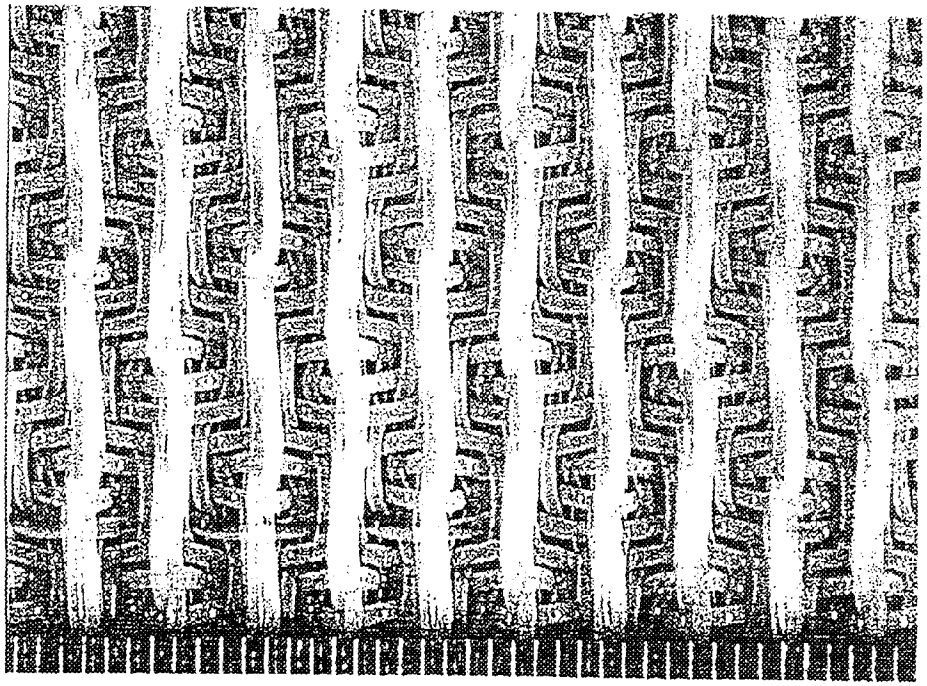

FIG. 4 is a plan view photograph of the sheet contacting side of another papermaking fabric useful as a texturizing fabric for producing the tissue sheets of this invention. Only one shute diameter is present in the structure and the resulting rippled channel depth is 0.72 mm, or 218% of the combined warp and weighted-average shute diameters.

Figure 5:
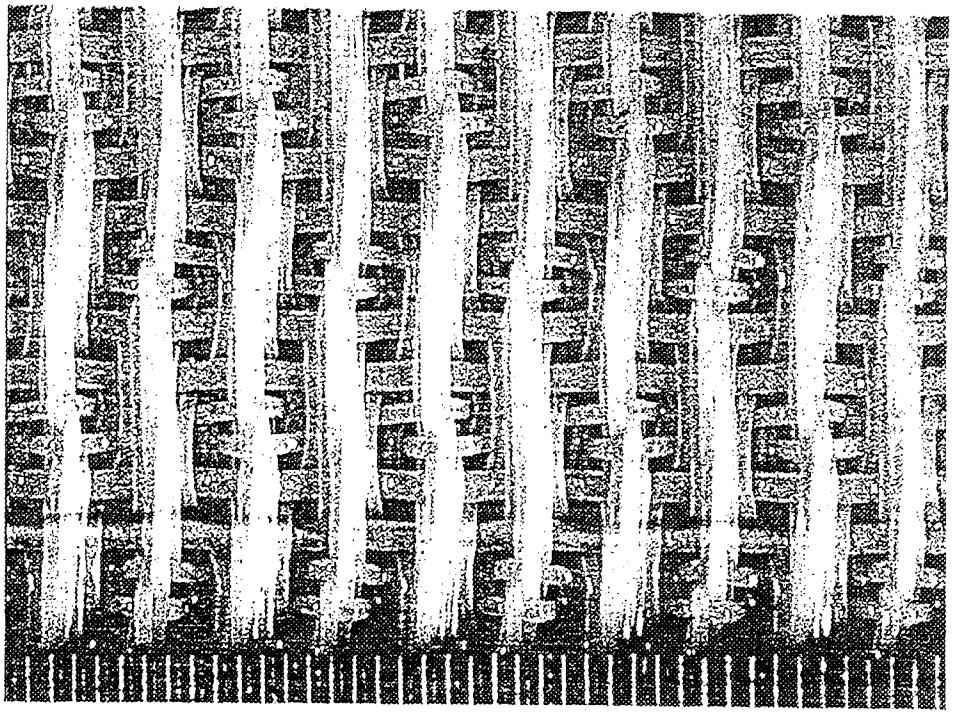

FIG. 5 is a plan view photograph of the sheet contacting side of another papermaking fabric useful as a texturizing fabric for producing the tissue sheets of this invention. Two different shute diameters are present in the structure and the fabric ripples or elevations are parallel to the machine direction.

Figure 6:
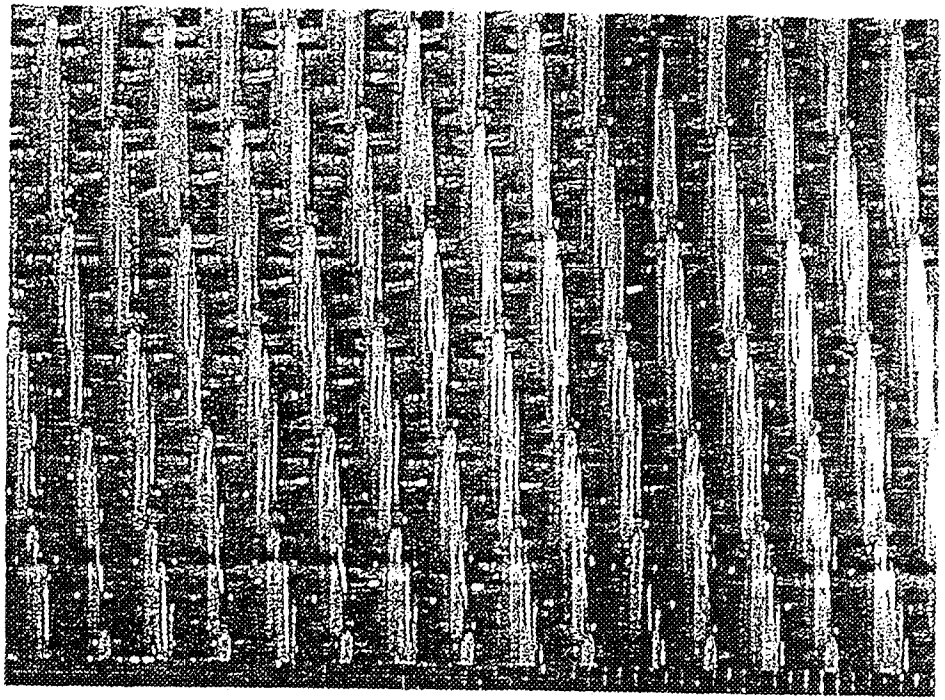

FIG. 6 is a plan view photograph of the tissue contacting side of another suitable texturizing fabric, illustrating an angled rippled structure. The fabric ripples are substantially continuous, not discrete, and formed of multiple warp strands grouped together and supported by multiple shute strands of three different diameters. Similar structures can be constructed using shute strands of one or more diameters. The warp strands are substantially oriented in the machine direction and each individual warp strand participates in both the structure of ripples and the structure of valleys. The fabric ridges and valleys are oriented at an angle of about 5 degrees relative to the true machine direction of the sheet. The angle is a function of both weave structure and pick count.

Figure 7:
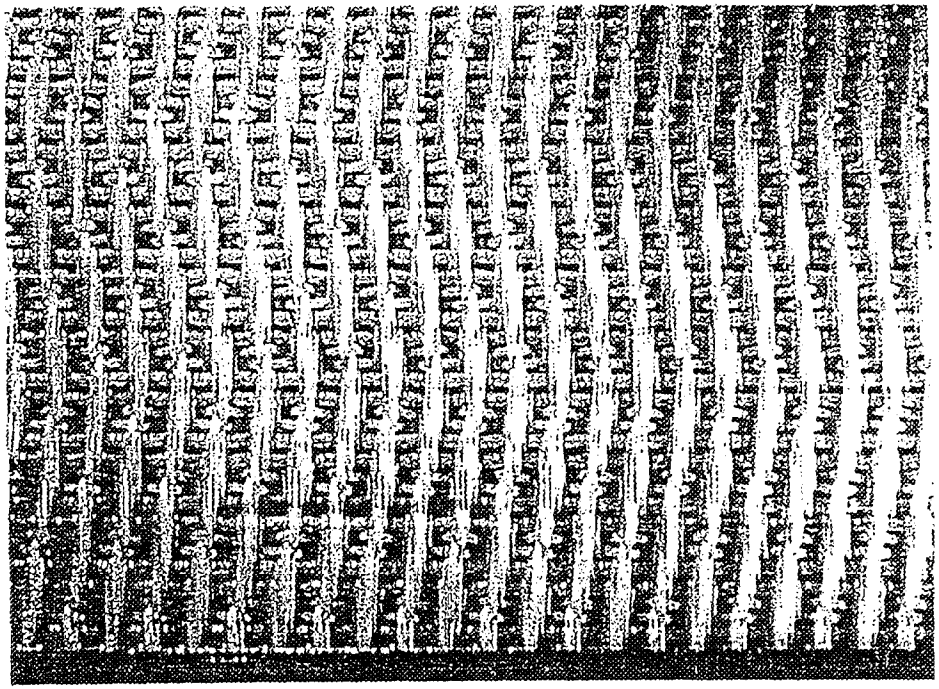

FIG. 7 is a plan view photograph of the tissue contacting side of another papermaking fabric useful as a texturizing fabric for producing the tissue sheets of this invention, illustrating the weave pattern and specific locations of the different diameter shutes used to produce the elevations. The fabric ripples or elevations are substantially continuous but aligned along a slight angle (up to 15 degrees) with respect to the machine direction. The ripples are higher and wider than individual warp strands and individual warp strands participate in both the fabric ripple and the fabric valley due to the warp strands being substantially oriented in the machine direction. The angle of the fabric ripples regularly reverse direction in terms of movement in the cross-machine direction, creating a wavy rippled appearance which can enhance tissue aesthetics or reduce the tendency for adjacent layers of tissue to nest along the rippled structure. For creped applications the wavy ripple also serves to alternate the locations along the Yankee dryer surface to which the tissue web is adhered. In the fabric shown, the ripple reverses direction after traversing approximately one-half of the cross-machine spacing between the ripples.

Other papermaking fabrics that may be used in conjunction with the process of the present disclosure are the PROLUX 003 fabric available from Albany, TISSUEMAX G fabric available from Voith Fabrics, or MONOSHAPE G fabric available from Asten-Johnson. The fabric, for instance, may have a 5-shed granite weave. The fabric can have pocket depths, measured between the top plane of the fabric and the highest point of the shute knuckles, of approximately 50% of the warp yarn diameter. In one embodiment, for instance, the fabric may comprise a 5-shed single layer fabric with a mesh and count of 42×31 per inch with 0.35 mm diameter warp filaments and 0.45 mm diameter shute (cross-direction) filaments. The fabric, for instance, can have a warp density from about 40% to about 70%, such as from about 55% to about 65%. The fabric can have a shute density of from about 35% to about 75%, such as from about 50% to about 60%. In one embodiment, for instance, the fabric may have a warp density of about 58% and shute density of about 55%.

In addition to elevations made by a fabric weave, in an alternative embodiment, the topographical surface may include elevations formed by deflection elements that are attached or otherwise integrated into a porous substrate, such as a fabric. For example, other topographical surfaces that may be used in the process of the present disclosure are described in any of the U.S. Pat. No. 4,514,345 issued on Apr. 30, 1985, to Johnson et al.; U.S. Pat. No. 4,528,239 issued on Jul. 9, 1985, to Trokhan; U.S. Pat. No. 5,098,522 issued on Mar. 24, 1992; U.S. Pat. No. 5,260,171 issued on Nov. 9, 1993, to Smurkoski et al.; U.S. Pat. No. 5,275,700 issued on Jan. 4, 1994, to Trokhan; U.S. Pat. No. 5,328,565 issued on Jul. 12, 1994, to Rasch et al.; U.S. Pat. No. 5,334,289 issued on Aug. 2, 1994, to Trokhan et al.; U.S. Pat. No. 5,431,786 issued on Jul. 11, 1995, to Rasch et al.; U.S. Pat. No. 5,496,624 issued on Mar. 5, 1996, to Steltjes, Jr. et al.; U.S. Pat. No. 5,500,277 issued on Mar. 19, 1996, to Trokhan et al.; U.S. Pat. No. 5,514,523 issued on May 7, 1996, to Trokhan et al.; U.S. Pat. No. 5,554,467 issued on Sep. 10, 1996, to Trokhan et al.; U.S. Pat. No. 5,566,724 issued on Oct. 22, 1996, to Trokhan et al.; U.S. Pat. No. 5,624,790 issued on Apr. 29, 1997, to Trokhan et al.; and, U.S. Pat. No. 5,628,876 issued on May 13, 1997, to Ayers et al., the disclosures of which are incorporated herein by reference to the extent that they are non-contradictory herewith. Such imprinting fabrics include deflection elements that are elevated from the surface.

Figure 8:
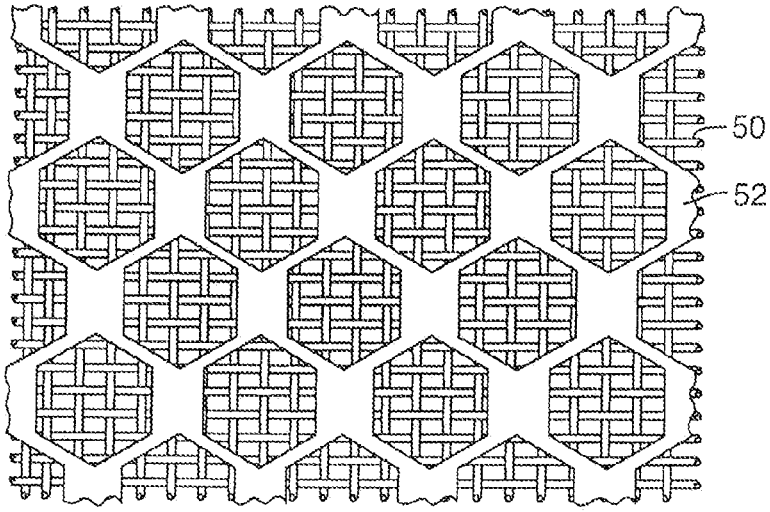

Referring to FIGS. 8-11, for instance, various topographical surfaces that may be used in accordance with the present disclosure are shown. For instance, FIG. 8 illustrates a topographical surface that includes a base fabric 50 attached to a reticulated deflection element 52. In this embodiment, the deflection element 52, comprises a reticulated pattern of open hexagon-shaped elements. The deflection element 52 extends above the surface of the fabric 50 and is intended to contact the tissue web at selected locations for additive composition transfer.

Figure 9:
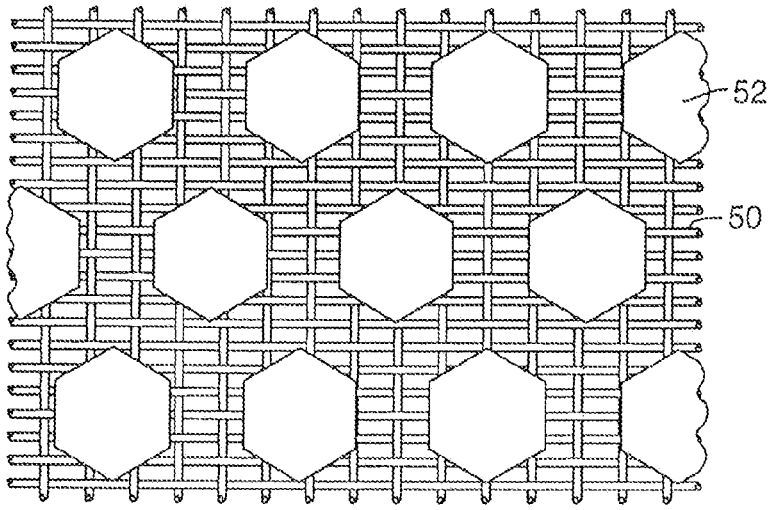

Referring to FIG. 9, another embodiment of a topographical surface including deflection elements is illustrated. Like reference numerals have been used to indicate the same or similar elements. In this embodiment, the topographical surface includes a base fabric 50 and a plurality of discrete deflection elements 52. The deflection elements 52 are in the shape of hexagons and form elevated regions on the fabric. When used in accordance with the present disclosure, each deflection element 52 presses the tissue web against the creping surface for causing controlled additive composition transfer.

Figure 10:
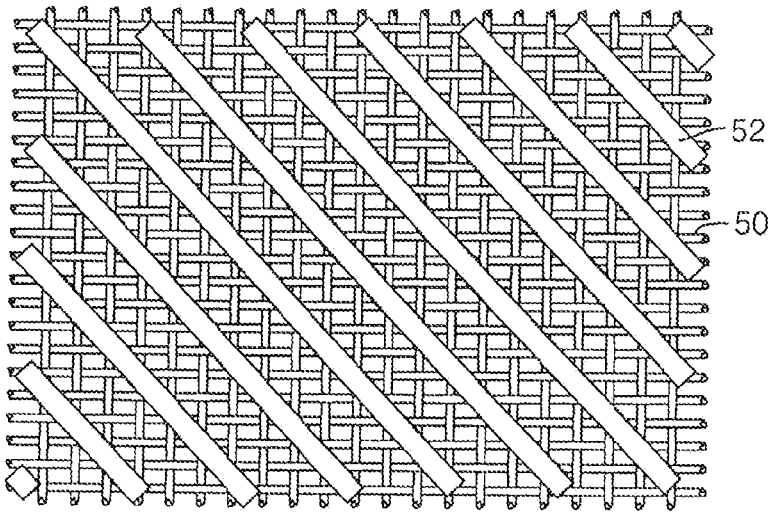
Figure 11:
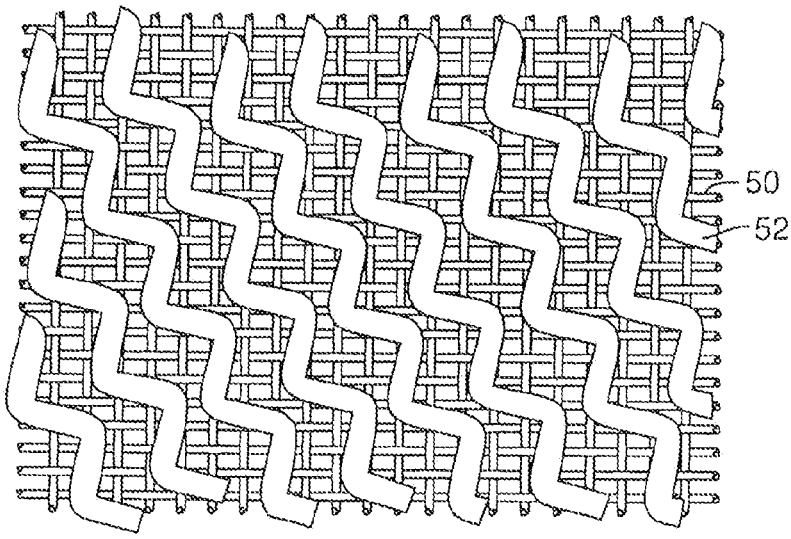

Referring to FIGS. 10 and 11, still other embodiments of topographical surfaces is shown. In FIG. 10, the deflection elements 52 comprise bars that extend diagonally across a base fabric 50. In FIG. 11, the deflection elements 52 comprise bars that have zig-zag shape.

It should be understood, that the embodiments illustrated in FIGS. 8-11 are merely exemplary. In this regard, the deflection elements can have any suitable shape depending upon the particular application and desired results.

As described above, the additive composition forms deposits on the tissue webs where the elevations on the topographical surface press the tissue web against the creping surface. The deposits are transferred to the tissue web in a pattern that mimics where the elevations are located on the topographical surface.

In some embodiments, in addition to the pattern of deposits, shavings of the additive composition may also transfer to the tissue web. It is believed that the shavings are formed by the creping blade as the web is creped from the surface. When present, the shavings generally have a higher density of the additive composition than the deposits. The shavings also appear randomly over the surface of the tissue web. For instance, the shavings may fall on the deposits, may overlap with some of the deposits, or may fall on the untreated areas of the tissue web. Of advantage, it was found that the shavings actually further enhance the property of the tissue web that is improved by the additive composition.

As described, in one embodiment, the additive composition may comprise a thermoplastic polymer resin. The thermoplastic polymer resin may be applied to the creping surface in a form of an aqueous dispersion. Once transferred to the tissue web in accordance with the present disclosure, the polymer dispersion may improve various properties of the web. For instance, the polymer may improve the geometric mean tensile strength and the geometric mean tensile energy absorbed of the web. Further, the strength of the web may be improved without adversely impacting the stiffness of the web. In fact, the thermoplastic polymer may improve the perceived softness of the web.

When comprising a thermoplastic resin, the additive composition generally contains an aqueous dispersion comprising at least one thermoplastic resin, water, and, optionally, at least one dispersing agent. The thermoplastic resin is present within the dispersion at a relatively small particle size. For example, the average volumetric particle size of the polymer may be less than about 5 microns. The actual particle size may depend upon various factors including the thermoplastic polymer that is present in the dispersion. Thus, the average volumetric particle size may be from about 0.05 microns to about 5 microns, such as less than about 4 microns, such as less than about 3 microns, such as less than about 2 microns, such as less than about 1 micron. Particle sizes can be measured on a Coulter LS230 light-scattering particle size analyzer or other suitable device. When present in the aqueous dispersion and when present in the tissue web, the thermoplastic resin is typically found in a non-fibrous form.

The particle size distribution (polydispersity) of the polymer particles in the dispersion may be less than or equal to about 2.0, such as less than 1.9, 1.7 or 1.5.

Examples of aqueous dispersions that may be incorporated into the additive composition of the present disclosure are disclosed, for instance, in U.S. Patent Application Publication No. 2005/0100754, U.S. Patent Application Publication No. 2005/0192365, PCT Publication No. WO 2005/021638, and PCT Publication No. WO 2005/021622, which are all incorporated herein by reference.

In this embodiment, the additive composition can remain primarily on the surface of the tissue web. In this manner, not only does the discontinuous treatment allow the tissue web to absorb fluids that contact the surface but also does not significantly interfere with the ability of the tissue web to absorb relatively large amounts of fluid. Thus, the additive composition does not significantly interfere with the liquid absorption properties of the web while increasing the strength of the web without substantially impacting adversely on the stiffness of the web.

The thickness of the additive composition when present on the surface of a base sheet can vary depending upon the ingredients of the additive composition and the amount applied. In general, for instance, the thickness can vary from about 0.01 microns to about 10 microns. At higher add-on levels, for instance, the thickness may be from about 3 microns to about 8 microns. At lower add-on levels, however, the thickness may be from about 0.1 microns to about 1 micron, such as from about 0.3 microns to about 0.7 microns.

The thermoplastic resin contained within the additive composition may vary depending upon the particular application and the desired result. In one embodiment, for instance, thermoplastic resin is an olefin polymer. As used herein, an olefin polymer refers to a class of unsaturated open-chain hydrocarbons having the general formula $C_nH_{2n}$. The olefin polymer may be present as a copolymer, such as an interpolymer. As used herein, a substantially olefin polymer refers to a polymer that contains less than about 1% substitution.

In one particular embodiment, for instance, the olefin polymer may comprise an alpha-olefin interpolymer of ethylene or propylene with at least one comonomer selected from the group consisting of a $C_4$-$C_{20}$ linear, branched or cyclic diene, or an ethylene vinyl compound, such as vinyl acetate, and a compound represented by the formula $H_2C{=}CHR$ wherein R is a $C_1$-$C_{20}$ linear, branched or cyclic alkyl group or a $C_6$-$C_{20}$ aryl group. Examples of comonomers include propylene, 1-butene, 3-methyl-1-butene, 4-methyl-1-pentene, 3-methyl-1-pentene, 1-heptene, 1-hexene, 1-octene, 1-decene, and 1-dodecene. In some embodiments, the interpolymer of ethylene has a density of less than about 0.92 g/cc.

In other embodiments, the thermoplastic resin comprises an alpha-olefin interpolymer of propylene with at least one comonomer selected from the group consisting of ethylene, a $C_4$-$C_{20}$ linear, branched or cyclic diene, and a compound represented by the formula $H_2C{=}CHR$ wherein R is a $C_1$-$C_{20}$ linear, branched or cyclic alkyl group or a $C_6$-$C_{20}$ aryl group. Examples of comonomers include ethylene, 1-butene, 3-methyl-1-butene, 4-methyl-1-pentene, 3-methyl-1-pentene, 1-heptene, 1-hexene, 1-octene, 1-decene, and 1-dodecene. In some embodiments, the comonomer is present at about 5% by weight to about 25% by weight of the interpolymer. In one embodiment, a propylene-ethylene interpolymer is used.

Other examples of thermoplastic resins which may be used in the present disclosure include homopolymers and copolymers (including elastomers) of an olefin such as ethylene, propylene, 1-butene, 3-methyl-1-butene, 4-methyl-1-pentene, 3-methyl-1-pentene, 1-heptene, 1-hexene, 1-octene, 1-decene, and 1-dodecene as typically represented by polyethylene, polypropylene, poly-1-butene, poly-3-methyl-1-butene, poly-3-methyl-1-pentene, poly-4-methyl-1-pentene, ethylene-propylene copolymer, ethylene-1-butene copolymer, and propylene-1-butene copolymer; copolymers (including elastomers) of an alpha-olefin with a conjugated or non-conjugated diene as typically represented by ethylene-butadiene copolymer and ethylene-ethylidene norbornene copolymer; and polyolefins (including elastomers) such as copolymers of two or more alpha-olefins with a conjugated or non-conjugated diene as typically represented by ethylene-propylene-butadiene copolymer, ethylene-propylene-dicyclopentadiene copolymer, ethylene-propylene-1,5-hexadiene copolymer, and ethylene-propylene-ethylidene norbornene copolymer; ethylene-vinyl compound copolymers such as ethylene-vinyl acetate copolymers with N-methylol functional comonomers, ethylene-vinyl alcohol copolymers with N-methylol functional comonomers, ethylene-vinyl chloride copolymer, ethylene acrylic acid or ethylene-(meth)acrylic acid copolymers, and ethylene-(meth)acrylate copolymer; styrenic copolymers (including elastomers) such as polystyrene, ABS, acrylonitrile-styrene copolymer, methylstyrene-styrene copolymer; and styrene block copolymers (including elastomers) such as styrene-butadiene copolymer and hydrate thereof, and styrene-isoprene-styrene triblock copolymer; polyvinyl compounds such as polyvinyl chloride, polyvinylidene chloride, vinyl chloride-vinylidene chloride copolymer, polymethyl acrylate, and polymethyl methacrylate; polyamides such as nylon 6, nylon 6,6, and nylon 12; thermoplastic polyesters such as polyethylene terephthalate and polybutylene terephthalate; polycarbonate, polyphenylene oxide, and the like. These resins may be used either alone or in combinations of two or more.

In particular embodiments, polyolefins such as polypropylene, polyethylene, and copolymers thereof and blends thereof, as well as ethylene-propylene-diene terpolymers are used. In some embodiments, the olefinic polymers include homogeneous polymers described in U.S. Pat. No. 3,645,992 by Elston; high density polyethylene (HDPE) as described in U.S. Pat. No. 4,076,698 to Anderson; heterogeneously branched linear low density polyethylene (LLDPE); heterogeneously branched ultra low linear density (ULDPE); homogeneously branched, linear ethylene/alpha-olefin copolymers; homogeneously branched, substantially linear ethylene/alpha-olefin polymers which can be prepared, for example, by a process disclosed in U.S. Pat. Nos. 5,272,236 and 5,278,272, the disclosure of which process is incorporated herein by reference; and high pressure, free radical polymerized ethylene polymers and copolymers such as low density polyethylene (LDPE). In still another embodiment of the present invention, the thermoplastic resin comprises an ethylene-carboxylic acid copolymer, such as ethylene-acrylic acid (EAA) and ethylene-methacrylic acid copolymers such as for example those available under the tradenames PRIMACOR™ from The Dow Chemical Company, NUCREL™ from DuPont, and ESCOR™ from ExxonMobil, and described in U.S. Pat. Nos. 4,599,392, 4,988,781, and 5,384,373, each of which is incorporated herein by reference in its entirety, and ethylene-vinyl acetate (EVA) copolymers. Polymer compositions described in U.S. Pat. Nos. 6,538,070, 6,566,446, 5,869,575, 6,448,341, 5,677,383, 6,316,549, 6,111,023, or 5,844,045, each of which is incorporated herein by reference in its entirety, are also suitable in some embodiments. Of course, blends of polymers can be used as well. In some embodiments, the blends include two different Ziegler-Natta polymers. In other embodiments, the blends can include blends of a Ziegler-Natta and a metallocene polymer. In still other embodiments, the thermoplastic resin used herein is a blend of two different metallocene polymers.

In one particular embodiment, the thermoplastic resin comprises an alpha-olefin interpolymer of ethylene with a comonomer comprising an alkene, such as 1-octene. The ethylene and octene copolymer may be present alone in the additive composition or in combination with another thermoplastic resin, such as ethylene-acrylic acid copolymer. Of particular advantage, the ethylene-acrylic acid copolymer not only is a thermoplastic resin, but also serves as a dispersing agent. When present together, the weight ratio between the ethylene and octene copolymer and the ethylene-acrylic acid copolymer may be from about 1:10 to about 10:1, such as from about 3:2 to about 2:3.

The thermoplastic resin, such as the ethylene and octene copolymer, may have a crystallinity of less than about 50%, such as less than about 25%. The polymer may have been produced using a single site catalyst and may have a weight average molecular weight of from about 15,000 to about 5 million, such as from about 20,000 to about 1 million. The molecular weight distribution of the polymer may be from about 1.01 to about 40, such as from about 1.5 to about 20, such as from about 1.8 to about 10.

In one particular embodiment, the thermoplastic resin is a propylene/alpha-olefin copolymer, which is characterized as having substantially isotactic propylene sequences. "Substantially isotactic propylene sequences" means that the sequences have an isotactic triad (mm) measured by $^{13}C$ NMR of greater than about 0.85; in the alternative, greater than about 0.90; in another alternative, greater than about 0.92; and in another alternative, greater than about 0.93. Isotactic triads are well-known in the art and are described in, for example, U.S. Pat. No. 5,504,172 and International Publication No. WO 00/01745, which refer to the isotactic sequence in terms of a triad unit in the copolymer molecular chain determined by $^{13}C$ NMR spectra.

The propylene/alpha-olefin copolymer may have a melt flow rate in the range of from 0.1 to 15 g/10 minutes, measured in accordance with ASTM D-1238 (at 230° C./2.16 Kg). All individual values and subranges from 0.1 to 15 g/10 minutes are included herein and disclosed herein; for example, the melt flow rate can be from a lower limit of 0.1 g/10 minutes, 0.2 g/10 minutes, or 0.5 g/10 minutes to an upper limit of 15 g/10 minutes, 10 g/10 minutes, 8 g/10 minutes, or 5 g/10 minutes. For example, the propylene/alpha-olefin copolymer may have a melt flow rate in the range of 0.1 to 10 g/10 minutes; or in the alternative, the propylene/alpha-olefin copolymer may have a melt flow rate in the range of 0.2 to 10 g/10 minutes.

The propylene/alpha-olefin copolymer has a crystallinity in the range of from at least 1 percent by weight (a heat of fusion of at least 2 Joules/gram) to 30 percent by weight (a heat of fusion of less than 50 Joules/gram). All individual values and subranges from 1 percent by weight (a heat of fusion of at least 2 Joules/gram) to 30 percent by weight (a heat of fusion of less than 50 Joules/gram) are included herein and disclosed herein; for example, the crystallinity can be from a lower limit of 1 percent by weight (a heat of fusion of at least 2 Joules/gram), 2.5 percent (a heat of fusion of at least 4 Joules/gram), or 3 percent (a heat of fusion of at least 5 Joules/gram) to an upper limit of 30 percent by weight (a heat of fusion of less than 50 Joules/gram), 24 percent by weight (a heat of fusion of less than 40 Joules/gram), 15 percent by weight (a heat of fusion of less than 24.8 Joules/gram) or 7 percent by weight (a heat of fusion of less than 11 Joules/gram). For example, the propylene/alpha-olefin copolymer may have a crystallinity in the range of from at least 1 percent by weight (a heat of fusion of at least 2 Joules/gram) to 24 percent by weight (a heat of fusion of less than 40 Joules/gram); or in the alternative, the propylene/alpha-olefin copolymer may have a crystallinity in the range of from at least 1 percent by weight (a heat of fusion of at least 2 Joules/gram) to 15 percent by weight (a heat of fusion of less than 24.8 Joules/gram); or in the alternative, the propylene/alpha-olefin copolymer may have a crystallinity in the range of from at least 1 percent by weight (a heat of fusion of at least 2 Joules/gram) to 7 percent by weight (a heat of fusion of less than 11 Joules/gram); or in the alternative, the propylene/alpha-olefin copolymer may have a crystallinity in the range of from at least 1 percent by weight (a heat of fusion of at least 2 Joules/gram) to 5 percent by weight (a heat of fusion of less than 8.3 Joules/gram). The crystallinity is measured via DSC method, as described above.

The propylene/alpha-olefin copolymer comprises units derived from propylene and polymeric units derived from one or more alpha-olefin comonomers. Exemplary comonomers utilized to manufacture the propylene/alpha-olefin copolymer are $C_2$, and $C_4$ to $C_{10}$ alpha-olefins; for example, $C_2$, $C_4$, $C_6$ and $C_8$ alpha-olefins.

The propylene/alpha-olefin copolymer comprises from 1 to 40 percent by weight of one or more alpha-olefin comonomers. All individual values and subranges from 1 to 40 weight percent are included herein and disclosed herein; for example, the comonomer content can be from a lower limit of 1 weight percent, 3 weight percent, 4 weight percent, 5 weight percent, 7 weight percent, or 9 weight percent to an upper limit of 40 weight percent, 35 weight percent, 30 weight percent, 27 weight percent, 20 weight percent, 15 weight percent, 12 weight percent, or 9 weight percent. For example, the propylene/alpha-olefin copolymer comprises from 1 to 35 percent by weight of one or more alpha-olefin comonomers; or in the alternative, the propylene/alpha-olefin copolymer comprises from 1 to 30 percent by weight of one or more alpha-olefin comonomers; or in the alternative, the propylene/alpha-olefin copolymer comprises from 3 to 27 percent by weight of one or more alpha-olefin comonomers; or in the alternative, the propylene/alpha-olefin copolymer comprises from 3 to 20 percent by weight of one or more alpha-olefin comonomers; or in the alternative, the propylene/alpha-olefin copolymer comprises from 3 to 15 percent by weight of one or more alpha-olefin comonomers.

The propylene/alpha-olefin copolymer has a molecular weight distribution (MWD), defined as weight average molecular weight divided by number average molecular weight ($M_w/M_n$) of 3.5 or less; in the alternative 3.0 or less; or in another alternative from 1.8 to 3.0.

Such propylene/alpha-olefin copolymers are further described in details in the U.S. Pat. Nos. 6,960,635 and 6,525,157, incorporated herein by reference. Such propylene/alpha-olefin copolymers are commercially available from The Dow Chemical Company, under the tradename VERSIFY™, or from ExxonMobil Chemical Company, under the tradename VISTAMAXX™. In one embodiment, the propylene/alpha-olefin copolymers are further characterized as comprising (A) between 60 and less than 100, preferably between 80 and 99 and more preferably between 85 and 99, weight percent units derived from propylene, and (B) between greater than zero and 40, preferably between 1 and 20, more preferably between 4 and 16 and even more preferably between 4 and 15, weight percent units derived from at least one of ethylene and/or a $C_{4-10}$ α-olefin; and containing an average of at least 0.001, preferably an average of at least 0.005 and more preferably an average of at least 0.01, long chain branches/1000 total carbons. The maximum number of long chain branches in the propylene interpolymer is not critical to the definition of this invention, but typically it does not exceed 3 long chain branches/1000 total carbons. The term long chain branch, as used herein, refers to a chain length of at least one (1) carbon more than a short chain branch, and short chain branch, as used herein, refers to a chain length of two (2) carbons less than the number of carbons in the comonomer. For example, a propylene/1-octene interpolymer has backbones with long chain branches of at least seven (7) carbons in length, but these backbones also have short chain branches of only six (6) carbons in length. Such propylene/alpha-olefin copolymers are further described in details in the U.S. Provisional Patent Application No. 60/988,999 and International Patent Application No. PCT/US08/082599, each of which is incorporated herein by reference.

In other selected embodiments, olefin block copolymers, e.g., ethylene multi-block copolymer, such as those described in the International Publication No. WO2005/090427 and U.S. patent application Ser. No. 11/376,835 may be used as the thermoplastic resin polymer. Such olefin block copolymer may be an ethylene/α-olefin interpolymer:

(a) having a $M_w/M_n$ from about 1.7 to about 3.5, at least one melting point, $T_m$, in degrees Celsius, and a density, d, in grams/cubic centimeter, wherein the numerical values of $T_m$ and d corresponding to the relationship:

$$T_m > -2002.9 + 4538.5(d) - 2422.2(d)^2; \text{ or}$$

(b) having a $M_w/M_n$ from about 1.7 to about 3.5, and being characterized by a heat of fusion, ΔH in J/g, and a delta quantity, ΔT, in degrees Celsius defined as the temperature difference between the tallest DSC peak and the tallest CRYSTAF peak, wherein the numerical values of ΔT and ΔH having the following relationships:

$$\Delta T > -0.1299(\Delta H) + 62.81 \text{ for } \Delta H \text{ greater than zero and up to 130 J/g,}$$

$$\Delta T > 48° \text{ C. for } \Delta H \text{ greater than 130 J/g,}$$

wherein the CRYSTAF peak being determined using at least 5 percent of the cumulative polymer, and if less than 5 percent of the polymer having an identifiable CRYSTAF peak, then the CRYSTAF temperature being 30° C.; or (c) being characterized by an elastic recovery, Re, in percent at 300 percent strain and 1 cycle measured with a compression-molded film of the ethylene/α-olefin interpolymer, and having a density, d, in grams/cubic centimeter, wherein the numerical values of Re and d satisfying the following relationship when ethylene/α-olefin interpolymer being substantially free of a cross-linked phase:

$$Re > 1481 - 1629(d); \text{ or}$$

(d) having a molecular fraction which elutes between 40° C. and 130° C. when fractionated using TREF, characterized in that the fraction having a molar comonomer content of at least 5 percent higher than that of a comparable random ethylene interpolymer fraction eluting between the same temperatures, wherein said comparable random ethylene interpolymer having the same comonomer(s) and having a melt index, density, and molar comonomer content (based on the whole polymer) within 10 percent of that of the ethylene/α-olefin interpolymer; or (e) having a storage modulus at 25° C., G' (25° C.), and a storage modulus at 100° C., G' (100° C.), wherein the ratio of G' (25° C.) to G' (100° C.) being in the range of about 1:1 to about 9:1.

The ethylene/α-olefin interpolymer may also:

(a) have a molecular fraction which elutes between 40° C. and 130° C. when fractionated using TREF, characterized in that the fraction having a block index of at least 0.5 and up to about 1 and a molecular weight distribution, $M_w/M_n$, greater than about 1.3; or (b) have an average block index greater than zero and up to about 1.0 and a molecular weight distribution, $M_w/M_n$, greater than about 1.3.

In alternative embodiments, polyolefins such as polypropylene, polyethylene, and copolymers thereof, and blends thereof, as well as ethylene-propylene-diene terpolymers, may be used as the base polymer. In some embodiments, exemplary olefinic polymers include, but are not limited to, homogeneous polymers described in U.S. Pat. No. 3,645,992 issued to Elston; high density polyethylene (HDPE) as described in U.S. Pat. No. 4,076,698 issued to Anderson; heterogeneously branched linear low density polyethylene (LLDPE); heterogeneously branched ultra low linear density polyethylene (ULDPE); homogeneously branched, linear ethylene/alpha-olefin copolymers; homogeneously branched, substantially linear ethylene/alpha-olefin polymers, which can be prepared, for example, by a process disclosed in U.S. Pat. Nos. 5,272,236 and 5,278,272, the disclosures of which are incorporated herein by reference; and high pressure, free radical polymerized ethylene polymers and copolymers such as low density polyethylene (LDPE).

Polymer compositions described in U.S. Pat. Nos. 6,566,446, 6,538,070, 6,448,341, 6,316,549, 6,111,023, 5,869,575, 5,844,045, or 5,677,383, each of which is incorporated herein by reference in its entirety, may be also be used as the base polymer. Of course, blends of polymers can be used as well. In some embodiments, the blends of base polymers include two different Ziegler-Natta polymers. In other embodiments, the blends of base polymers can include blends of a Ziegler-Natta and a metallocene polymer. In still other embodiments, the base polymer blend may be a blend of two different metallocene polymers. In other embodiments polymers produced from single site catalysts may be used. In yet another embodiment, block or multi-block copolymers may be used. Such polymers include those described and claimed in WO2005/090427 (having priority to U.S. Ser. No. 60/553,906, filed Mar. 7, 2004).

Depending upon the thermoplastic polymer, the melt index of the polymer may range from about 0.001 g/10 min to about 1,000 g/10 min, such as from about 0.5 g/10 min to about 800 g/10 min. For example, in one embodiment, the melt index of the thermoplastic resin may be from about 100 g/10 min to about 700 g/10 min.

The thermoplastic resin may also have a relatively low melting point. For instance, the melting point of the thermoplastic resin may be less than about 140° C., such as less than 130° C., such as less than 120° C. For instance, in one embodiment, the melting point may be less than about 90° C. The glass transition temperature of the thermoplastic resin may also be relatively low. For instance, the glass transition temperature may be less than about 50° C., such as less than about 40° C.

The one or more thermoplastic resins may be contained within the additive composition in an amount from about 1% by weight to about 96% by weight. For instance, the thermoplastic resin may be present in the aqueous dispersion in an amount from about 10% by weight to about 70% by weight, such as from about 20% to about 50% by weight.

In addition to at least one thermoplastic resin, the aqueous dispersion may also contain a dispersing agent. A dispersing agent is an agent that aids in the formation and/or the stabilization of the dispersion. One or more dispersing agents may be incorporated into the additive composition.

In general, any suitable dispersing agent can be used. In one embodiment, for instance, the dispersing agent comprises at least one carboxylic acid, a salt of at least one carboxylic acid, or carboxylic acid ester or salt of the carboxylic acid ester. Examples of carboxylic acids useful as a dispersant comprise fatty acids such as montanic acid, stearic acid, oleic acid, and the like. In some embodiments, the carboxylic acid, the salt of the carboxylic acid, or at least one carboxylic acid fragment of the carboxylic acid ester or at least one carboxylic acid fragment of the salt of the carboxylic acid ester has fewer than 25 carbon atoms. In other embodiments, the carboxylic acid, the salt of the carboxylic acid, or at least one carboxylic acid fragment of the carboxylic acid ester or at least one carboxylic acid fragment of the salt of the carboxylic acid ester has 12 to 25 carbon atoms. In some embodiments, carboxylic acids, salts of the carboxylic acid, at least one carboxylic acid fragment of the carboxylic acid ester or its salt has 15 to 25 carbon atoms are preferred. In other embodiments, the number of carbon atoms is 25 to 60. Some examples of salts comprise a cation selected from the group consisting of an alkali metal cation, alkaline earth metal cation, or ammonium or alkyl ammonium cation.

In still other embodiments, the dispersing agent is selected from the group consisting of ethylene-carboxylic acid polymers, and their salts, such as ethylene-acrylic acid copolymers or ethylene-methacrylic acid copolymers.

In other embodiments, the dispersing agent is selected from alkyl ether carboxylates, petroleum sulfonates, sulfonated polyoxyethylenated alcohol, sulfated or phosphated polyoxyethylenated alcohols, polymeric ethylene oxide/propylene oxide/ethylene oxide dispersing agents, primary and secondary alcohol ethoxylates, alkyl glycosides and alkyl glycerides.

When ethylene-acrylic acid copolymer is used as a dispersing agent, the copolymer may also serve as a thermoplastic resin.

In one particular embodiment, the aqueous dispersion contains an ethylene and octene copolymer and ethylene-acrylic acid copolymer. The dispersing agent may be present in the aqueous dispersion in an amount from about 0.1% to about 10% by weight.

In addition to the above components, the aqueous dispersion also contains water. Water may be added as tap water or as deionized water. The pH of the aqueous dispersion is generally less than about 12, such as from about 5 to about 11.5, such as from about 7 to about 11. The aqueous dispersion may have a solids content of less than about 75%, such as less than about 70%. For instance, the solids content of the aqueous dispersion may range from about 5% to about 60%.

While any method may be used to produce the aqueous dispersion, in one embodiment, the dispersion may be formed through a melt-kneading process. For example, the kneader may comprise a Banbury mixer, single-screw extruder or a multi-screw extruder. The melt-kneading may be conducted under the conditions which are typically used for melt-kneading the one or more thermoplastic resins.

In one particular embodiment, the process includes melt-kneading the components that make up the dispersion. The melt-kneading machine may include multiple inlets for the various components. For example, the extruder may include four inlets placed in series. Further, if desired, a vacuum vent may be added at an optional position of the extruder.

In some embodiments, the dispersion is first diluted to contain about 1 to about 3% by weight water and then, subsequently, further diluted to comprise greater than about 25% by weight water.

In an alternative embodiment, instead of using a thermoplastic polymer dispersion, the additive composition may comprise a lotion. The lotion, for instance, can be formulated to not only adhere the tissue web to the creping surface but may also be designed to transfer to the surface of the web in amounts sufficient to later provide benefits to the user. For instance, in one embodiment, the lotion can be transferred to the tissue web in an amount sufficient such that the lotion then later transfers to a user's skin when wiped across the skin by a user.

In general, any suitable lotion composition may be used that is capable of adhering the base sheet to the creping surface and thereafter transferring to the base sheet such that the base sheet increases in basis weight by greater than about 2% by weight. Examples of lotions that may be used in accordance with the present disclosure, for instance, are disclosed in U.S. Pat. No. 5,885,697, U.S. Patent Publication No. 2005/0058693, and/or U.S. Patent Publication No. 2005/0058833, which are all incorporated herein by reference.

In one embodiment, for instance, the lotion composition may comprise an oil, a wax, a fatty alcohol, and one or more other additional ingredients.

For instance, the amount of oil in the composition can be from about 30 to about 90 weight percent, more specifically from about 40 to about 70 weight percent, and still more specifically from about 45 to about 60 weight percent. Suitable oils include, but are not limited to, the following classes of oils: petroleum or mineral oils, such as mineral oil and petrolatum; animal oils, such as mink oil and lanolin oil; plant oils, such as aloe extract, sunflower oil and avocado oil; and silicone oils, such as dimethicone and alkyl methyl silicones.

The amount of wax in the composition can be from about 10 to about 40 weight percent, more specifically from about 10 to about 30 weight percent, and still more specifically from about 15 to about 25 weight percent. Suitable waxes include, but are not limited to the following classes: natural waxes, such as beeswax and carnauba wax; petroleum waxes, such as paraffin and ceresin wax; silicone waxes, such as alkyl methyl siloxanes; or synthetic waxes, such as synthetic beeswax and synthetic sperm wax.

The amount of fatty alcohol in the composition, if present, can be from about 5 to about 40 weight percent, more specifically from about 10 to about 30 weight percent, and still more specifically from about 15 to about 25 weight percent. Suitable fatty alcohols include alcohols having a carbon chain length of C.sub.14-C.sub.30, including cetyl alcohol, stearyl alcohol, behenyl alcohol, and dodecyl alcohol.

In order to better enhance the benefits to consumers, additional ingredients can be used. The classes of ingredients and their corresponding benefits include, without limitation, $C_{10}$ or greater fatty alcohols (lubricity, body, opacity); fatty esters (lubricity, feel modification); vitamins (topical medicinal benefits); dimethicone (skin protection); powders (lubricity, oil absorption, skin protection); preservatives and antioxidants (product integrity); ethoxylated fatty alcohols; (wetability, process aids); fragrance (consumer appeal); lanolin derivatives (skin moisturization), colorants, optical brighteners, sunscreens, alpha hydroxy acids, natural herbal extracts, and the like.

In one embodiment, the lotion composition can further contain a humectant. Humectants are typically cosmetic ingredients used to increase the water content of the top layers of the skin or mucous membrane, by helping control the moisture exchange between the product, the skin, and the atmosphere. Humectants may include primarily hydroscopic materials. Suitable humectants for inclusion in the moisturizing and lubrication compositions of the present disclosure include urocanic acid, N-Acetyl ethanolamine, aloe vera gel, arginine PCA, chitosan PCA, copper PCA, Corn glycerides, dimethyl imidazolidinone, fructose, glucamine, glucose, glucose glutamate, glucuronic acid, glutamic acid, glycereth-7, glycereth-12, glycereth-20, glycereth-26, glycerin, honey, hydrogenated honey, hydrogenated starch hydrolysates, hydrolyzed corn starch, lactamide MEA, lactic acid, lactose lysine PCA, mannitol, methyl gluceth-10, methyl gluceth-20, PCA, PEG-2 lactamide, PEG-10 propylene glycol, polyamino acids, polysaccharides, polyamino sugar condensate, potassium PCA, propylene glycol, propylene glycol citrate, saccharide hydrolysate, saccharide isomerate, sodium aspartate, sodium lactate, sodium PCA, sorbitol, TEA-lactate, TEA-PCA, Urea, Xylitol, and the like and mixtures thereof. Preferred humectants include polyols, glycerine, ethoxylated glycerine, polyethylene glycols, hydrogenated starch hydrolsates, propylene glycol, silicone glycol and pyrrolidone carboxylic acid.

In one embodiment, a lotion or one of the above ingredients contained in a lotion can be combined with a polymer dispersion as described above to produce an additive composition in accordance with the present disclosure having desired properties.

In still another embodiment, the additive composition may contain an adhesive, such as a latex polymer. The adhesive may be used alone if capable of transferring to the base sheet in sufficient amounts. Alternatively, the adhesive can be combined with various other components, such as a lotion or a thermoplastic resin as described above.

Latex emulsion polymers useful in accordance with this disclosure can comprise aqueous emulsion addition copolymerized unsaturated monomers, such as ethylenic monomers, polymerized in the presence of surfactants and initiators to produce emulsion-polymerized polymer particles. Unsaturated monomers contain carbon-to-carbon double bond unsaturation and generally include vinyl monomers, styrenic monomers, acrylic monomers, allylic monomers, acrylamide monomers, as well as carboxyl functional monomers. Vinyl monomers include vinyl esters such as vinyl acetate, vinyl propionate and similar vinyl lower alkyl esters, vinyl halides, vinyl aromatic hydrocarbons such as styrene and substituted styrenes, vinyl aliphatic monomers such as alpha olefins and conjugated dienes, and vinyl alkyl ethers such as methyl vinyl ether and similar vinyl lower alkyl ethers. Acrylic monomers include lower alkyl esters of acrylic or methacrylic acid having an alkyl ester chain from one to twelve carbon atoms as well as aromatic derivatives of acrylic and methacrylic acid. Useful acrylic monomers include, for instance, methyl, ethyl, butyl, and propyl acrylates and methacrylates, 2-ethyl hexyl acrylate and methacrylate, cyclohexyl, decyl, and isodecyl acrylates and methacrylates, and similar various acrylates and methacrylates.

In accordance with this disclosure, a carboxyl-functional latex emulsion polymer can contain copolymerized carboxyl-functional monomers such as acrylic and methacrylic acids, fumaric or maleic or similar unsaturated dicarboxylic acids, where the preferred carboxyl monomers are acrylic and methacrylic acid. The carboxyl-functional latex polymers comprise by weight from about 1% to about 50% copolymerized carboxyl monomers with the balance being other copolymerized ethylenic monomers. Preferred carboxyl-functional polymers include carboxylated vinyl acetate-ethylene terpolymer emulsions such as Airflex® 426 Emulsion, commercially available from Air Products Polymers, LP.

In other embodiments, the adhesive may comprise an ethylene carbon monoxide copolymer, a polyacrylate, or a polyurethane. In other embodiments, the adhesive may comprise a natural or synthetic rubber. For instance, the adhesive may comprise a styrene butadiene rubber, such as a carboxylic styrene butadiene rubber. In still another embodiment, the adhesive may comprise a starch, such as a starch blended with an aliphatic polyester.

In one embodiment, the adhesive is combined with other components to form the additive composition. For instance, the adhesive may be contained in the additive composition in an amount less than about 80% by weight, such as less than about 60% by weight, such as less than about 40% by weight, such as less than about 20% by weight, such as from about 2% by weight to about 30% by weight.

In addition, a lotion and/or a polymer dispersion may be combined with various other additives or ingredients. For instance, in one embodiment, a debonder may be present within the additive composition. A debonder is a chemical species that softens or weakens a tissue sheet by preventing the formation of hydrogen bonds.

Suitable debonding agents that may be used in the present disclosure include cationic debonding agents such as fatty dialkyl quaternary amine salts, mono fatty alkyl tertiary amine salts, primary amine salts, imidazoline quaternary salts, silicone quaternary salt and unsaturated fatty alkyl amine salts. Other suitable debonding agents are disclosed in U.S. Pat. No. 5,529,665 to Kaun which is incorporated herein by reference. In particular, Kaun discloses the use of cationic silicone compositions as debonding agents.

In one embodiment, the debonding agent used in the process of the present disclosure is an organic quaternary ammonium chloride and, particularly, a silicone-based amine salt of a quaternary ammonium chloride.

In one embodiment, the debonding agent can be PROSOFT® TQ1003, marketed by the Hercules Corporation. For example, one debonding agent that can be used is as follows:

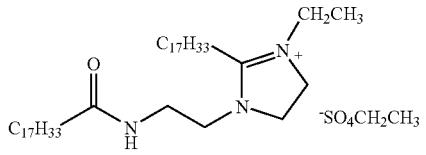

The Chemical Name for the Above is

1-Ethyl-2Noroleyl-3-Oleyl Amidoethyl Imidazolinium Ethosulfate

In another embodiment, the additive composition may comprise a softener, such as a polysiloxane softener. Silicones, such as polysiloxanes, however, may interfere with the ability of the additive composition to adhere a base sheet to a creping surface. Thus, when present, the polysiloxane can be added to the additive composition in an amount of less than about 5% by weight.

Still in another embodiment, various beneficial agents can be incorporated into the additive composition in any amount as desired. For instance, in one embodiment, aloe, vitamin E, a wax, an oxidized polyethylene, or mixtures thereof can be combined into the additive composition in amounts less than about 5% by weight, such as from about 0.1% to about 3% by weight. Such ingredients can be combined into a lotion, into a polymer dispersion as described above, or into a mixture of both.

In one embodiment, the additive composition can be preheated prior to being applied to the creping surface. For example, in some embodiments, heating the additive composition may decrease the viscosity. In particular, in some embodiments, the additive composition may have a melting point of, for instance, from about 30° C. to about 70° C. If desired, the additive composition can be heated above the melting point and then applied to the creping surface.

In the embodiments illustrated in the figures, only one side of the base sheet is treated with the additive composition. It should be understood, however, that both sides of the base sheet may be treated in accordance with the present disclosure. For instance, once one side of the base sheet is creped from a creping surface, the opposite side can be similarly adhered to a creping surface by the additive composition.

Numerous different types of base sheets may be processed according to the present disclosure. For instance, as particularly shown in FIG. 2, in one embodiment, the base sheet comprises a tissue web containing cellulosic fibers.

Tissue products made according to the present disclosure may include single-ply tissue products or multiple-ply tissue products. For instance, in one embodiment, the product may include two plies or three plies.

In general, any suitable tissue web may be treated in accordance with the present disclosure. For example, in one embodiment, the base sheet can be a tissue product, such as a bath tissue, a facial tissue, a paper towel, an industrial wiper, and the like. Tissue products typically have a bulk of at least 3 cc/g. The tissue products can contain one or more plies and can be made from any suitable types of fiber.

Fibers suitable for making tissue webs comprise any natural or synthetic cellulosic fibers including, but not limited to nonwoody fibers, such as cotton, abaca, kenaf, sabai grass, flax, esparto grass, straw, jute hemp, bagasse, milkweed floss fibers, and pineapple leaf fibers; and woody or pulp fibers such as those obtained from deciduous and coniferous trees, including softwood fibers, such as northern and southern softwood kraft fibers; hardwood fibers, such as eucalyptus, maple, birch, and aspen. Pulp fibers can be prepared in high-yield or low-yield forms and can be pulped in any known method, including kraft, sulfite, high-yield pulping methods and other known pulping methods. Fibers prepared from organosolv pulping methods can also be used, including the fibers and methods disclosed in U.S. Pat. No. 4,793,898, issued Dec. 27, 1988 to Laamanen et al.; U.S. Pat. No. 4,594,130, issued Jun. 10, 1986 to Chang et al.; and U.S. Pat. No. 3,585,104. Useful fibers can also be produced by anthraquinone pulping, exemplified by U.S. Pat. No. 5,595,628 issued Jan. 21, 1997, to Gordon et al.

A portion of the fibers, such as up to 50% or less by dry weight, or from about 5% to about 30% by dry weight, can be synthetic fibers such as rayon, polyolefin fibers, polyester fibers, bicomponent sheath-core fibers, multi-component binder fibers, and the like. An exemplary polyethylene fiber is Fybrel®, available from Minifibers, Inc. (Jackson City, Tenn.). Any known bleaching method can be used. Synthetic cellulose fiber types include rayon in all its varieties and other fibers derived from viscose or chemically-modified cellulose. Chemically treated natural cellulosic fibers can be used such as mercerized pulps, chemically stiffened or crosslinked fibers, or sulfonated fibers. For good mechanical properties in using papermaking fibers, it can be desirable that the fibers be relatively undamaged and largely unrefined or only lightly refined. While recycled fibers can be used, virgin fibers are generally useful for their mechanical properties and lack of contaminants. Mercerized fibers, regenerated cellulosic fibers, cellulose produced by microbes, rayon, and other cellulosic material or cellulosic derivatives can be used. Suitable papermaking fibers can also include recycled fibers, virgin fibers, or mixes thereof. In certain embodiments capable of high bulk and good compressive properties, the fibers can have a Canadian Standard Freeness of at least 200, more specifically at least 300, more specifically still at least 400, and most specifically at least 500.

Other papermaking fibers that can be used in the present disclosure include paper broke or recycled fibers and high yield fibers. High yield pulp fibers are those papermaking fibers produced by pulping processes providing a yield of about 65% or greater, more specifically about 75% or greater, and still more specifically about 75% to about 95%. Yield is the resulting amount of processed fibers expressed as a percentage of the initial wood mass. Such pulping processes include bleached chemithermomechanical pulp (BCTMP), chemithermomechanical pulp (CTMP), pressure/pressure thermomechanical pulp (PTMP), thermomechanical pulp (TMP), thermomechanical chemical pulp (TMCP), high yield sulfite pulps, and high yield Kraft pulps, all of which leave the resulting fibers with high levels of lignin. High yield fibers are well known for their stiffness in both dry and wet states relative to typical chemically pulped fibers.

If desired, various chemicals and ingredients may be incorporated into tissue webs that are processed according to the present disclosure. The following materials are included as examples of additional chemicals that may be applied to the web. The chemicals are included as examples and are not intended to limit the scope of the invention. Such chemicals may be added at any point in the papermaking process.

In general, the products of the present invention can be used in conjunction with any known materials and chemicals that are not antagonistic to its intended use. Examples of such materials include but are not limited to odor control agents, such as odor absorbents, activated carbon fibers and particles, baby powder, baking soda, chelating agents, zeolites, perfumes or other odor-masking agents, cyclodextrin compounds, oxidizers, and the like. Superabsorbent particles, synthetic fibers, or films may also be employed. Additional options include cationic dyes, optical brighteners, emollients, and the like.

The different chemicals and ingredients that may be incorporated into the base sheet may depend upon the end use of the product. For instance, various wet strength agents may be incorporated into the product. For bath tissue products, for example, temporary wet strength agents may be used. As used herein, wet strength agents are materials used to immobilize the bonds between fibers in the wet state. Typically, the means by which fibers are held together in paper and tissue products involve hydrogen bonds and sometimes combinations of hydrogen bonds and covalent and/or ionic bonds. In some applications, it may be useful to provide a material that will allow bonding to the fibers in such a way as to immobilize the fiber-to-fiber bond points and make them resistant to disruption in the wet state. The wet state typically means when the product is largely saturated with water or other aqueous solutions.

Any material that when added to a paper or tissue web results in providing the sheet with a mean wet geometric tensile strength:dry geometric tensile strength ratio in excess of 0.1 may be termed a wet strength agent.

Temporary wet strength agents, which are typically incorporated into bath tissues, are defined as those resins which, when incorporated into paper or tissue products, will provide a product which retains less than 50% of its original wet strength after exposure to water for a period of at least 5 minutes. Temporary wet strength agents are well known in the art. Examples of temporary wet strength agents include polymeric aldehyde-functional compounds such as glyoxylated polyacrylamide, such as a cationic glyoxylated polyacrylamide.

Such compounds include PAREZ 631 NC wet strength resin available from Lanxess of Trenton, N.J., and HERCOBOND 1366, manufactured by Hercules, Inc. of Wilmington, Del. Another example of a glyoxylated polyacrylamide is PAREZ 745, which is a glyoxylated poly(acrylamide-co-diallyl dimethyl ammonium chloride).

For facial tissues and other tissue products, on the other hand, permanent wet strength agents may be incorporated into the base sheet. Permanent wet strength agents are also well known in the art and provide a product that will retain more than 50% of its original wet strength after exposure to water for a period of at least 5 minutes.

Once formed, the products may be packaged in different ways. For instance, in one embodiment, the sheet-like product may be cut into individual sheets and stacked prior to being placed into a package. Alternatively, the sheet-like product may be spirally wound. When spirally wound together, each individual sheet may be separated from an adjacent sheet by a line of weakness, such as a perforation line. Bath tissues and paper towels, for instance, are typically supplied to a consumer in a spirally wound configuration.

Tissue webs that may be treated in accordance with the present disclosure may include a single homogenous layer of fibers or may include a stratified or layered construction. For instance, the tissue web ply may include two or three layers of fibers. Each layer may have a different fiber composition. For example, referring to FIG. 1, one embodiment of a device for forming a multi-layered stratified pulp furnish is illustrated. As shown, a three-layered headbox 60 generally includes an upper head box wall 62 and a lower head box wall 64. Headbox 60 further includes a first divider 66 and a second divider 68, which separate three fiber stock layers.

Each of the fiber layers comprise a dilute aqueous suspension of papermaking fibers. The particular fibers contained in each layer generally depends upon the product being formed and the desired results. For instance, the fiber composition of each layer may vary depending upon whether a bath tissue product, facial tissue product or paper towel is being produced. In one embodiment, for instance, middle layer 70 contains southern softwood kraft fibers either alone or in combination with other fibers such as high yield fibers. Outer layers 72 and 74, on the other hand, contain softwood fibers, such as northern softwood kraft.

In an alternative embodiment, the middle layer may contain softwood fibers for strength, while the outer layers may comprise hardwood fibers, such as eucalyptus fibers, for a perceived softness.

An endless traveling forming fabric 76, suitably supported and driven by rolls 78 and 80, receives the layered papermaking stock issuing from headbox 60. Once retained on fabric 76, the layered fiber suspension passes water through the fabric as shown by the arrows 82. Water removal is achieved by combinations of gravity, centrifugal force and vacuum suction depending on the forming configuration.

Forming multi-layered paper webs is also described and disclosed in U.S. Pat. No. 5,129,988 to Farrington. Jr., which is incorporated herein by reference.

The basis weight of tissue webs made in accordance with the present disclosure can vary depending upon the final product. For example, the process may be used to produce bath tissues, facial tissues, paper towels, industrial wipers, and the like. In general, the basis weight of the tissue products may vary from about 10 gsm to about 110 gsm, such as from about 20 gsm to about 90 gsm. For bath tissue and facial tissues, for instance, the basis weight may range from about 10 gsm to about 45 gsm.

The tissue web bulk may also vary from about 3 cc/g to 20 cc/g, such as from about 5 cc/g to 15 cc/g. The sheet "bulk" is calculated as the quotient of the caliper of a dry tissue sheet, expressed in microns, divided by the dry basis weight, expressed in grams per square meter. The resulting sheet bulk is expressed in cubic centimeters per gram. More specifically, the caliper is measured as the total thickness of a stack of ten representative sheets and dividing the total thickness of the stack by ten, where each sheet within the stack is placed with the same side up. Caliper is measured in accordance with TAPPI test method T411 om-89 "Thickness (caliper) of Paper, Paperboard, and Combined Board" with Note 3 for stacked sheets. The micrometer used for carrying out T411 om-89 is an Emveco 200-A Tissue Caliper Tester available from Emveco, Inc., Newberg, Oreg. The micrometer has a load of 2.00 kilo-Pascals (132 grams per square inch), a pressure foot area of 2500 square millimeters, a pressure foot diameter of 56.42 millimeters, a dwell time of 3 seconds and a lowering rate of 0.8 millimeters per second.

In multiple ply products, the basis weight of each tissue web present in the product can also vary. In general, the total basis weight of a multiple ply product will generally be the same as indicated above, such as from about 20 gsm to about 110 gsm. The basis weight of each ply in certain embodiments can be from about 10 gsm to about 20 gsm.

In one embodiment, tissue webs made according to the present disclosure can be incorporated into multiple-ply products. For instance, in one embodiment, a tissue web made according to the present disclosure can be attached to one or more other tissue webs for forming a wiping product having desired characteristics. The other webs laminated to the tissue web of the present disclosure can be, for instance, a wet-creped web, a calendered web, an embossed web, a through-air dried web, a creped through-air dried web, an uncreped through-air dried web, a hydroentangled web, a coform web, an airlaid web, and the like.

In one embodiment, when incorporating a tissue web made according to the present disclosure into a multiple-ply product, it may be desirable to only apply the additive composition to one side of the tissue web and to crepe the treated side of the web. The creped side of the web is then used to form an exterior surface of a multiple ply product. The untreated and uncreped side of the web, on the other hand, is attached by any suitable means to one or more plies.

In addition to wet lay processes as shown in FIG. 2, it should be understood that various other base sheets may be treated in accordance with the present disclosure. For instance, other base sheets that may be treated in accordance with the present disclosure include airlaid webs, coform webs, hydroentangled webs, meltblown webs, spunbond webs, woven materials, knitted materials, and the like.

Other materials containing cellulosic fibers include coform webs and hydroentangled webs. In the coform process, at least one meltblown diehead is arranged near a chute through which other materials are added to a meltblown web while it is forming. Such other materials may be natural fibers, superabsorbent particles, natural polymer fibers (for example, rayon) and/or synthetic polymer fibers (for example, polypropylene or polyester), for example, where the fibers may be of staple length.

Coform processes are shown in commonly assigned U.S. Pat. No. 4,818,464 to Lau and U.S. Pat. No. 4,100,324 to Anderson et al., which are incorporated herein by reference. Webs produced by the coform process are generally referred to as coform materials. More particularly, one process for producing coform nonwoven webs involves extruding a molten polymeric material through a die head into fine streams and attenuating the streams by converging flows of high velocity, heated gas (usually air) supplied from nozzles to break the polymer streams into discontinuous microfibers of small diameter. The die head, for instance, can include at least one straight row of extrusion apertures. In general, the microfibers may have an average fiber diameter of up to about 10 microns. The average diameter of the microfibers can be generally greater than about 1 micron, such as from about 2 microns to about 5 microns. While the microfibers are predominantly discontinuous, they generally have a length exceeding that normally associated with staple fibers.

In order to combine the molten polymer fibers with another material, such as pulp fibers, a primary gas stream is merged with a secondary gas stream containing the individualized wood pulp fibers. Thus, the pulp fibers become integrated with the polymer fibers in a single step. The wood pulp fibers can have a length of from about 0.5 millimeters to about 10 millimeters. The integrated air stream is then directed onto a forming surface to air form the nonwoven fabric. The nonwoven fabric, if desired, may be passed into the nip of a pair of vacuum rolls in order to further integrate the two different materials.

Natural fibers that may be combined with the meltblown fibers include wool, cotton, flax, hemp and wood pulp. Wood pulps include standard softwood fluffing grade such as CR-1654 (US Alliance Pulp Mills, Coosa, Ala.). Pulp may be modified in order to enhance the inherent characteristics of the fibers and their processability. Curl may be imparted to the fibers by methods including chemical treatment or mechanical twisting. Curl is typically imparted before crosslinking or stiffening. Pulps may be stiffened by the use of crosslinking agents such as formaldehyde or its derivatives, glutaraldehyde, epichlorohydrin, methylolated compounds such as urea or urea derivatives, dialdehydes such as maleic anhydride, non-methylolated urea derivatives, citric acid or other polycarboxylic acids. Pulp may also be stiffened by the use of heat or caustic treatments such as mercerization. Examples of these types of fibers include NHB416 which is a chemically crosslinked southern softwood pulp fibers which enhances wet modulus, available from the Weyerhaeuser Corporation of Tacoma, Wash. Other useful pulps are debonded pulp (NF405) and non-debonded pulp (NB416) also from Weyerhaeuser. HPZ3 from Buckeye Technologies, Inc of Memphis, Tenn., has a chemical treatment that sets in a curl and twist, in addition to imparting added dry and wet stiffness and resilience to the fiber. Another suitable pulp is Buckeye HP2 pulp and still another is IP Supersoft from International Paper Corporation. Suitable rayon fibers are 1.5 denier Merge 18453 fibers from Acordis Cellulose Fibers Incorporated of Axis, Ala.

When containing cellulosic materials such as pulp fibers, a coform material may contain the cellulosic material in an amount from about 10% by weight to about 80% by weight, such as from about 30% by weight to about 70% by weight. For example, in one embodiment, a coform material may be produced containing pulp fibers in an amount from about 40% by weight to about 60% by weight.

In addition to coform webs, hydroentangled webs can also contain synthetic and pulp fibers. Hydroentangled webs refer to webs that have been subjected to columnar jets of a fluid that cause the fibers in the web to entangle. Hydroentangling a web typically increases the strength of the web. In one embodiment, pulp fibers can be hydroentangled into a continuous filament material, such as a spunbond web. The hydroentangled resulting nonwoven composite may contain pulp fibers in an amount from about 50% to about 80% by weight, such as in an amount of about 70% by weight. Commercially available hydroentangled composite webs as described above are commercially available from the Kimberly-Clark Corporation under the name HYDROKNIT.

Hydraulic entangling is described in, for example, U.S. Pat. No. 5,389,202 to Everhart, which is incorporated herein by reference.

In addition to base sheets containing cellulosic fibers, the present disclosure is also directed to applying additive compositions to base sheets made entirely from synthetic fibers. For instance, in one embodiment, the base sheet may comprise a nonwoven meltblown web or spunbond web.

The present disclosure may be better understood with reference to the following example.

EXAMPLE 1

In this example, tissue webs were made generally according to the process illustrated in FIG. 2. In order to adhere the tissue web to a creping surface, which in this embodiment comprised a Yankee dryer, additive compositions made according to the present disclosure were sprayed onto the dryer prior to contacting the dryer with the web. The samples were then subjected to various standardized tests.

For purposes of comparison, samples were also produced using a standard PVOH/KYMENE crepe package.

The following process was used to produce the samples.

Initially, 80 pounds of air-dried softwood kraft (NSWK) pulp was placed into a pulper and disintegrated for 15 minutes at 4% consistency at 120 degrees F. Then, the NSWK pulp was refined for 15 minutes, transferred to a dump chest and subsequently diluted to approximately 3% consistency. (Note: Refining fibrillates fibers to increase their bonding potential.) Then, the NSWK pulp was diluted to about 2% consistency and pumped to a machine chest, such that the machine chest contained 20 air-dried pounds of NSWK at about 0.2-0.3% consistency. The above softwood fibers were utilized as the inner strength layer in a 3-layer tissue structure.

Two kilograms KYMENE® 6500, available from Hercules, Incorporated, located in Wilmington, Del., U.S.A., per metric ton of wood fiber and two kilograms per metric ton of wood fiber PAREZ® 631 NC, available from LANXESS Corporation., located in Trenton, N.J., U.S.A., was added and allowed to mix with the pulp fibers for at least 10 minutes before pumping the pulp slurry through the headbox.

Forty pounds of air-dried Aracruz ECF, a eucalyptus hardwood Kraft (EHWK) pulp available from Aracruz, located in Rio de Janeiro, RJ, Brazil, was placed into a pulper and disintegrated for 30 minutes at about 4% consistency at 120 degrees Fahrenheit. The EHWK pulp was then transferred to a dump chest and subsequently diluted to about 2% consistency.

Next, the EHWK pulp slurry was diluted, divided into two equal amounts, and pumped at about 1% consistency into two separate machine chests, such that each machine chest contained 20 pounds of air-dried EHWK. This pulp slurry was subsequently diluted to about 0.1% consistency. The two EHWK pulp fibers represent the two outer layers of the 3-layered tissue structure.

Two kilograms KYMENE® 6500 per metric ton of wood fiber was added and allowed to mix with the hardwood pulp fibers for at least 10 minutes before pumping the pulp slurry through the headbox.

The pulp fibers from all three machine chests were pumped to the headbox at a consistency of about 0.1%. Pulp fibers from each machine chest were sent through separate manifolds in the headbox to create a 3-layered tissue structure. The fibers were deposited on a forming fabric. Water was subsequently removed by vacuum.

The wet sheet, about 10-20% consistency, was transferred to a topographical surface, a press felt or press fabric where it was further dewatered. In this example, the topographical surface comprised a three-dimensional fabric having elevated knuckles. The fabric used was a 5-shed single layer fabric with a mesh and count of 42×31 per inch with 0.35 mm diameter machine direction warp filaments and 0.45 mm diameter cross-direction shute filaments. The fabric had a warp density of about 58% and a shute density of about 55%. The sheet was then transferred to a Yankee dryer through a nip via a pressure roll. The consistency of the wet sheet after the pressure roll nip (post-pressure roll consistency or PPRC) was approximately 40%. The wet sheet adhered to the Yankee dryer due to a composition that is applied to the dryer surface. Spray booms situated underneath the Yankee dryer sprayed either an adhesive package, which is a mixture of polyvinyl alcohol/KYMENE® 6500/Rezosol 2008M, or an additive composition according to the present disclosure onto the dryer surface. Rezosol 2008M is available from Hercules, Incorporated, located in Wilmington, Del., U.S.A.

One batch of the typical adhesive package on the continuous handsheet former (CHF) typically consisted of 25 gallons of water, 5000 mL of a 6% solids polyvinyl alcohol solution, 75 mL of a 12.5% solids KYMENE® 6500 solution, and 20 mL of a 7.5% solids Rezosol 2008M solution.

The sheet was dried to about 95% consistency as it traveled on the Yankee dryer and to the creping blade. The creping blade subsequently scraped the tissue sheet and small amounts of dryer coating off the Yankee dryer. The creped tissue base sheet was then wound onto a core.

In particular, the following tests were performed on the samples: Geometric Mean Tensile Strength (GMT), and Hercules Size Test (HST):

The tensile test that was performed used tissue samples that were conditioned at 23° C.±1° C. and 50%±2% relative humidity for a minimum of 4 hours. The 2-ply samples were cut into 3 inch wide strips in the machine direction (MD) and cross-machine direction (CD) using a precision sample cutter model JDC 15M-10, available from Thwing-Albert Instruments, a business having offices located in Philadelphia, Pa., U.S.A.

The gauge length of the tensile frame was set to four inches. The tensile frame was an Alliance RT/1 frame run with TestWorks 4 software. The tensile frame and the software are available from MTS Systems Corporation, a business having offices located in Minneapolis, Minn., U.S.A.

A 3" strip was then placed in the jaws of the tensile frame and subjected to a strain applied at a rate of 25.4 cm per minute until the point of sample failure. The stress on the tissue strip is monitored as a function of the strain. The calculated outputs included the peak load (grams-force/3", measured in grams-force), the peak stretch (%, calculated by dividing the elongation of the sample by the original length of the sample and multiplying by 100%), the % stretch @ 500 grams-force, the tensile energy absorption (TEA) at break (grams-force*cm/cm$^2$, calculated by integrating or taking the area under the stress-strain curve up the point of failure where the load falls to 30% of its peak value), and the slope A (kilograms-force, measured as the slope of the stress-strain curve from 57-150 grams-force).

Each tissue code (minimum of five replicates) was tested in the machine direction (MD) and cross-machine direction (CD). Geometric means of the tensile strength were calculated as the square root of the product of the machine direction (MD) and the cross-machine direction (CD). This yielded an average value that is independent of testing direction.

The "Hercules Size Test" (HST) is a test that generally measures how long it takes for a liquid to travel through a tissue sheet. Hercules size testing was done in general accordance with TAPPI method T 530 PM-89, Size Test for Paper with Ink Resistance. Hercules Size Test data was collected on a Model HST tester using white and green calibration tiles and the black disk provided by the manufacturer. A 2% Napthol Green N dye diluted with distilled water to 1% was used as the dye. All materials are available from Hercules, Inc., Wilmington, Del.

All specimens were conditioned for at least 4 hours at 23±1 C and 50±2% relative humidity prior to testing. The test is sensitive to dye solution temperature so the dye solution should also be equilibrated to the controlled condition temperature for a minimum of 4 hours before testing.

Six (6) tissue sheets as commercially sold (18 plies for a 3-ply tissue product, 12 plies for a two-ply product, 6 plies for a single ply product, etc.) form the specimen for testing. Specimens are cut to an approximate dimension of 2.5×2.5 inches. The instrument is standardized with white and green calibration tiles per the manufacturer's directions. The specimen (12 plies for a 2-ply tissue product) is placed in the sample holder with the outer surface of the plies facing outward. The specimen is then clamped into the specimen holder. The specimen holder is then positioned in the retaining ring on top of the optical housing. Using the black disk, the instrument zero is calibrated. The black disk is removed and 10±0.5 milliliters of dye solution is dispensed into the retaining ring and the timer started while placing the black disk back over the specimen. The test time in seconds (sec.) is recorded from the instrument.

The additive composition of the present disclosure that was applied to the samples and tested in this example included AFFINITY™ EG8200 polymer which is an alpha-olefin interpolymer comprising an ethylene and octene copolymer that was obtained from The Dow Chemical Company of Midland, Mich., U.S.A.; and PRIMACOR™ 5980i copolymer which is an ethylene-acrylic acid copolymer also obtained from The Dow Chemical Company. The ethylene-acrylic acid copolymer can serve not only as a thermoplastic polymer but also as a dispersing agent. PRIMACOR™ 5980i copolymer contains 20.5% by weight acrylic acid and has a melt flow rate of 13.75 g/10 min at 125° C. and 2.16 kg as measured by ASTM D1238. AFFINITY™ EG8200G polymer has a density of 0.87 g/cc as measured by ASTM D792 and has a melt flow rate of 5 g/10 min at 190° C. and 2.16 kg as measured by ASTM D1238.

The additive composition contained the AFFINITY™ EG8200G polymer in an amount of 60% by weight and the PRIMACOR™ 5980i product in an amount of 40% by weight.

A preservative was also present in the additive compositions.

The additive compositions that were formulated varied in solids content which also changed the amount of additive composition that was transferred to the tissue web. In one sample, the additive composition had a solids content of 2% by weight which resulted in applying 200 mg/m2 to the tissue web. In another sample, the solids content of the additive composition was at 4% which transferred approximately 400 mg/m2 of the composition to the tissue web.

For comparative purposes, a similar tissue web to the one described above was also produced in which a felt as opposed to a topographical surface was used to apply the web to the creping surface. The following results were obtained:

| Sample No. | Composition | GMT | Caliper (μm) | Basis Weight (gsm) | Bulk (cc/g) | Hercules ST (sec) |
|---|---|---|---|---|---|---|
| Control 1 | Conventional Creping Adhesive | 774 | 294 | 27.6 | 10.65 | 0.7 |
| Control 2 | Additive Composition at 2% solids using felt as transfer conveyor | 701 | 224 | 28.35 | 7.90 | 2.4 |
| Sample 1 | Additive Composition at 2% solids | 748 | 308 | 28.04 | 10.98 | 1.3 |
| Sample 2 | Additive Composition at 4% solids | 757 | 296 | 27.86 | 10.62 | 2.6 |

Figure 12:
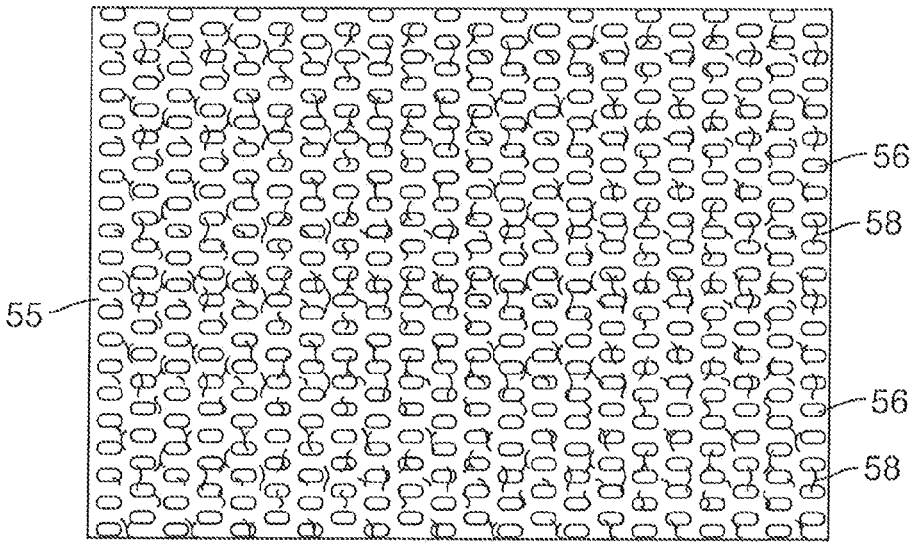
FIGS. 12 and 13 are reproductions of photographs taken of a tissue sheet made in accordance with the present disclosure.
Figure 13:
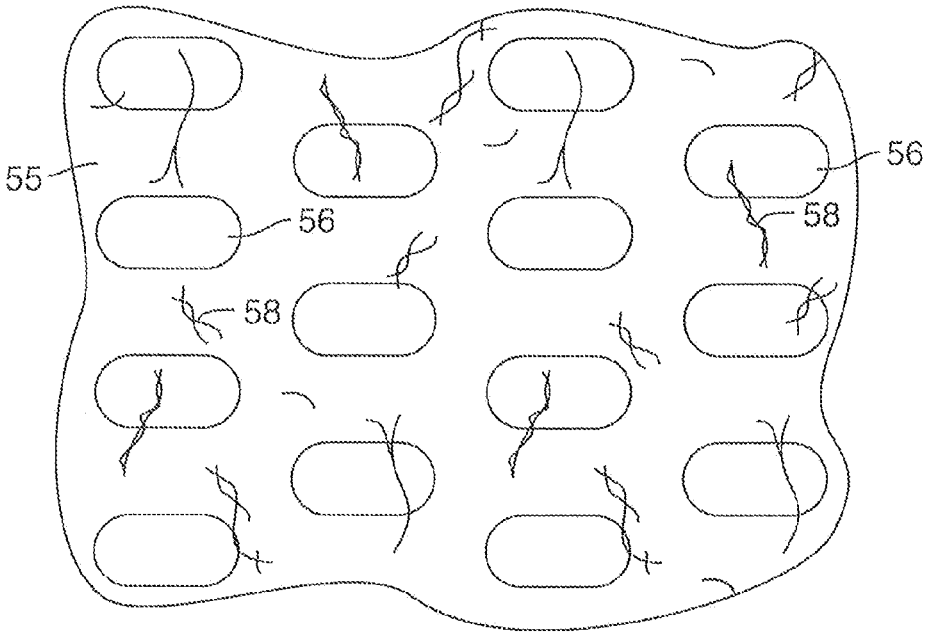

Referring to FIGS. 12 and 13, a tissue web made according to sample #2 above is shown. In particular, after the tissue web was produced, the tissue web was stained with methylene blue dye and photographs were taken of the web. FIGS. 12 and 13 are simplified but representative drawings based upon the photographs that were taken. FIG. 13 is a greater magnification of the tissue web shown in FIG. 12.

As shown in FIGS. 12 and 13, the tissue web 55 includes a plurality of deposits 56 comprised of the additive composition. As shown in FIG. 12, the spacing of the deposits 56 is relatively uniform and is consistent with the spacing of the elevated fabric knuckles that were used to press the tissue web against the creping surface.

As also shown in FIGS. 12 and 13, randomly deposited are shavings 58 also made from the additive composition. As described above, the shavings can provide further advantages and benefits by providing relatively high dense areas of the additive composition at discrete locations on the web.

For purposes of comparison, control sample #2 was also dyed and examined. It was observed that the additive composition on the control sample had no discernable pattern of deposits on the web and appeared to uniformly cover the surface area of the web.

These and other modifications and variations to the present disclosure may be practiced by those of ordinary skill in the art, without departing from the spirit and scope of the present disclosure, which is more particularly set forth in the appended claims. In addition, it should be understood that aspects of the various embodiments may be interchanged either in whole or in part. Furthermore, those of ordinary skill in the art will appreciate that the foregoing description is by way of example only, and is not intended to limit the disclosure so further described in such appended claims.

What is claimed is:

1. A creped tissue sheet containing papermaking fibers comprising a first side and a second and opposite side, the creped tissue sheet treated with an additive composition comprising an olefin polymer located on the first side of the sheet in a pattern, the pattern including deposits of the additive composition separated by untreated areas, the creped tissue sheet further comprising shavings of the additive composition randomly dispersed on the first side of the sheet.

2. A creped tissue sheet as defined in claim 1 wherein the shavings have a thicker mass of additive composition in comparison to the deposits.

3. A creped tissue sheet as defined in claim 1, wherein the deposits comprise discrete treated areas bordered by untreated areas.

4. A creped tissue sheet as defined in claim 1, wherein the shavings overlap at least some of the deposits.

5. A creped tissue sheet as defined in claim 1, wherein the tissue sheet has been wet-pressed.

6. A creped tissue sheet as defined in claim 1, wherein the tissue sheet has a bulk greater than 5 cc/g and has a basis weight of from about 10 gsm to about 60 gsm.

7. A creped tissue sheet as defined in claim 1, wherein the olefin polymer comprises an interpolymer of ethylene or propylene with a co-monomer comprising an alkene.

8. A creped tissue sheet as defined in claim 7, wherein the co-monomer comprises octene.

9. A creped tissue sheet as defined in claim 1, wherein the additive composition further comprises a dispersing agent.

10. A creped tissue sheet as defined in claim 9, wherein the dispersing agent comprises an ethylene-carboxylic acid copolymer.

11. A creped tissue sheet as defined in claim 1, wherein the pattern of deposits cover from about 5 percent to about 80 percent of the surface area of the first side of the tissue sheet.

12. A creped tissue sheet as defined in claim 1, wherein the additive composition is present on the first side of the sheet in an amount from about 1 percent to about 50 percent by weight of the sheet.

13. A creped tissue sheet as defined in claim 1, wherein the creped tissue sheet has a bulk greater than 3 cc/g and contains cellulosic fibers in an amount greater than 50% by weight.

* * * * *